US009020372B2

(12) United States Patent
Yako

(10) Patent No.: US 9,020,372 B2
(45) Date of Patent: Apr. 28, 2015

(54) IMAGE FORMING APPARATUS CAPABLE OF REDUCING RECOVERY PRINTING TIME

(71) Applicant: Canon Kabushiki Kaisha, Tokyo (JP)

(72) Inventor: Yasuhiro Yako, Tokyo (JP)

(73) Assignee: Canon Kabushiki Kaisha (JP)

( * ) Notice: Subject to any disclaimer, the term of this patent is extended or adjusted under 35 U.S.C. 154(b) by 74 days.

(21) Appl. No.: 14/010,746

(22) Filed: Aug. 27, 2013

(65) Prior Publication Data

US 2014/0064748 A1 Mar. 6, 2014

(30) Foreign Application Priority Data

Aug. 29, 2012 (JP) ..... 2012-188618

(51) Int. Cl.
*G03G 15/00* (2006.01)
*G03G 15/01* (2006.01)

(52) U.S. Cl.
CPC ..... *G03G 15/5012* (2013.01); *G03G 15/0136* (2013.01)

(58) Field of Classification Search
USPC ..... 399/19
See application file for complete search history.

(56) References Cited

U.S. PATENT DOCUMENTS

| | | | | |
|---|---|---|---|---|
| 5,532,793 | A * | 7/1996 | Kogure | 399/19 |
| 5,761,567 | A * | 6/1998 | Yoshizuka | 399/17 |
| 6,011,936 | A * | 1/2000 | Kaneko | 399/21 |
| 6,775,486 | B2 * | 8/2004 | Matsuyama et al. | 399/21 |
| 6,876,820 | B2 * | 4/2005 | Hirai et al. | 399/21 |
| 8,291,262 | B2 * | 10/2012 | Tsujimoto | 714/18 |
| 8,380,090 | B2 * | 2/2013 | Hanayama | 399/19 |
| 2006/0263112 | A1 * | 11/2006 | Umetani et al. | 399/130 |

FOREIGN PATENT DOCUMENTS

JP 3848177 B2 11/2006

* cited by examiner

*Primary Examiner* — Anthony Nguyen
(74) *Attorney, Agent, or Firm* — Rossi, Kimms & McDowell LLP

(57) ABSTRACT

An image forming apparatus capable of properly reducing recovery printing time, while reducing abrasion and deterioration of image bearing members. As an image formation mode determining method, a first method is selected before a print job is interrupted e.g. a jam, whereas for recovery printing, one of the first method and a second method is selected. In the first method, if an image to be formed is a color image, an image formation mode is set to an all-contact mode having an intermediate transfer belt brought into contact with all of photosensitive members, and if the image is a monochrome image, the mode is set to a partial-contact mode having the belt brought into contact only with a photosensitive member for black toner. In the second method, the mode is set to the all-contact mode for all pages on which image formation is to be performed.

11 Claims, 23 Drawing Sheets

FIG.12A

| NUMBER OF READ PAGES (ReadPage) |
|---|
| 1 |

FIG.12B

| PAGE NUMBER (PageNum) | COLOR INFORMATION (ColorInfo) |
|---|---|
| 1 | COLOR (1) / MONOCHROME (0) |

FIG.12C

| NUMBER OF READ PAGES (ReadPage) (NUMBER OF REMAINING PAGES) |
|---|
| 10 |

FIG.12D

| PAGE NUMBER (PageNum) | COLOR INFORMATION (ColorInfo) |
|---|---|
| 1 | COLOR (1) |
| 2 | MONOCHROME (0) |
| 3 | MONOCHROME (0) |
| 4 | COLOR (1) |
| 5 | MONOCHROME (0) |
| 6 | MONOCHROME (0) |
| 7 | COLOR (1) |
| 8 | MONOCHROME (0) |
| 9 | MONOCHROME (0) |
| 10 | COLOR (1) |

IMAGE FORMING APPARATUS CAPABLE OF REDUCING RECOVERY PRINTING TIME

BACKGROUND OF THE INVENTION

1. Field of the Invention

The present invention relates to an image forming apparatus that performs image formation in a plurality of colors, and is capable of reducing recovery printing time.

2. Description of the Related Art

Conventionally, as a color image forming apparatus using an electrophotographic process, there has been known one using a method of primarily transferring a toner image formed on a photosensitive member onto an intermediate transfer belt and thereafter secondarily transferring the toner image on the intermediate transfer belt onto a recording sheet.

For example, in a tandem-type color image forming apparatus, four photosensitive members for yellow toner, magenta toner, cyan toner, and black toner are arranged along a direction of rotating the intermediate transfer belt. Each of the photosensitive members and the intermediate transfer belt are rotated while being in contact with each other, whereby toner images formed on the respective photosensitive members are sequentially transferred onto the intermediate transfer belt in a superimposed manner to form a color image on the intermediate transfer belt. Then, the color image formed on the intermediate transfer belt is transferred onto a recording sheet by a transfer section located downstream in the rotational direction.

Image formation modes of the apparatus of this type include a color image formation mode for forming a four-color image by driving all of the four photosensitive members, and a monochrome image formation mode for forming an image by driving only the photosensitive member for black toner.

Although a color image is formed by superimposing four color toner images of yellow, magenta, cyan, and black, a monochrome image can be formed using only black toner. That is, toner of three colors of yellow, magenta, and cyan is not required for monochrome image formation, and hence the intermediate transfer belt is not required to be brought into contact with the photosensitive members for toner of the three colors. Therefore, usually, the intermediate transfer belt is brought into contact with all of the four photosensitive members in the color image formation mode, and is brought into contact only with the photosensitive member for black toner in the monochrome image formation mode.

However, it is possible to print a monochrome page by setting the position of the intermediate transfer belt relative to the photosensitive member of each color to a position for color image formation. For example, in continuous printing in which color pages and monochrome pages are printed in a mixed manner, if both of color and monochrome images are formed by bringing the intermediate transfer belt into contact with the four photosensitive members, it is possible to obtain an advantage that there is no need to switch the image formation mode page by page, which reduces the whole printing time by a time period required to switch the mode. However, the above-mentioned printing method causes the photosensitive members for color toner to rotate in the state brought into contact with the intermediate transfer belt even in monochrome image formation, which is not preferable in terms of unnecessarily accelerated abrasion and deterioration of the photosensitive members for color toner.

In view of the above-described circumstances, there has been proposed a method of determining an image formation mode, which aims to satisfy the two requirements of reduction of the whole printing time and prevention of the photosensitive members from being wastefully abraded and deteriorated (Japanese Patent No. 3848177). In Japanese Patent No. 3848177, part of monochrome pages is printed in the color image formation mode depending on how color pages and monochrome pages are mixed. This reduces the number of times of switching between the image formation modes to thereby reduce the whole printing time, and also reduces unnecessarily accelerated abrasion and deterioration of the three photosensitive members for color toner.

However, in Japanese Patent No. 3848177, in a case where a print job is interrupted e.g. due to a paper jam (hereinafter also simply referred to as a jam), even in recovery printing for printing the remaining pages after clearing the jam, the image formation mode is determined by using the same method as that used before the print job is interrupted.

Therefore, the number of times of switching between the image formation modes in recovery printing after interruption of the print job is the same as that in printing the remaining pages in a case where the job is not interrupted. That is, in both of the cases, the same time period is required for the total mode switching time period, and hence the time lost by job interruption e.g. due to a jam is directly added to the total printing time.

In general, when performing a printing operation using an image forming apparatus, a user empirically estimates a time period required to complete the printing operation to some degree of accuracy from the number of pages, how color pages and monochrome pages are mixed, and so on, based on productivity (the printable number of sheets per minute) of the apparatus used for the printing operation. The time period estimated by the user at this time is normally based on the premise that the printing operation is not interrupted in the middle of printing. For example, in a case where documents are required to be printed for the purpose of usage in a meeting, and a time period required for printing is estimated to be 30 minutes, the user starts printing in view of more than half an hour before the start of the meeting.

However, according to the method of determining the image formation mode disclosed in Japanese Patent No. 3848177, if a job is interrupted, a time period required to clear a jam is added to the total printing time period, and hence completion of printing is largely delayed from the finish time estimated by the user. As a result, the print output may be late for the scheduled meeting.

As described above, the apparatus disclosed in Japanese Patent No. 3848177 uses the same method of determining the image formation mode in recovery printing as well. This brings about a problem that it is impossible to properly reduce the recovery printing time depending on the situation, and it is impossible to recover the time lost by job interruption.

SUMMARY OF THE INVENTION

The present invention provides an image forming apparatus capable of properly reducing recovery printing time, while reducing abrasion and deterioration of image bearing members.

In a first aspect of the present invention, there is provided an image forming apparatus that performs a sequence of image formation processing operations according to a print job, for forming a toner image on at least one of a plurality of image bearing members, transferring the toner image formed on at least one of the plurality of image bearing members onto a belt member, and further transferring the toner image, which has been transferred onto the belt member, onto a recording sheet, comprising a shift unit configured to shift the belt member to thereby switch a position of the belt member relative to the plurality of image bearing members to an all-contact position in which the belt member is in contact with all of the plurality of image bearing members or a partial-contact position in which the belt member is in contact with only part of the plurality of image bearing members, a first obtaining unit configured to obtain color information indicative of whether an image to be formed is a color image or a monochrome image, concerning each page on which image formation is to be performed according to the print job, a recovery unit configured to perform recovery printing in a case where the print job is interrupted due to a cause of interruption, a determination unit configured to determine, based on the color information obtained by the first obtaining unit, whether or not a color image is included in respective images for pages on which image formation is to be performed in recovery printing, and a selection unit configured to select, as a method of determining in which of the all-contact position and the partial-contact position, the shift unit is to position the belt member, a first determination method before a print job is interrupted, and select, based on a result of determination performed by the determination unit, one of the first determination method and a second determination method, for recovery printing after interruption of the print job, wherein the first determination method is a method of positioning the belt member in the all-contact position when an image of a page on which image formation is to be performed is a color image, and positioning the belt member in the partial-contact position when an image of a page on which image formation is to be performed is a monochrome image, and wherein the second determination method is a method of positioning the belt member in the all-contact position for all pages on which image formation is to be performed.

In a second aspect of the present invention, there is provided an image forming apparatus that performs a sequence of image formation processing operations according to a print job, for forming a toner image on at least one of a plurality of image bearing members, transferring the toner image formed on at least one of the plurality of image bearing members onto a belt member, and further transferring the toner image, which has been transferred onto the belt member, onto a recording sheet, comprising a shift unit configured to shift the belt member to thereby switch a position of the belt member relative to the plurality of image bearing members to an all-contact position in which the belt member is in contact with all of the plurality of image bearing members or a partial-contact position in which the belt member is in contact with only part of the plurality of image bearing members, a first obtaining unit configured to obtain color information indicative of whether an image to be formed is a color image or a monochrome image, concerning each page on which image formation is to be performed according to the print job, a recovery unit configured to perform recovery printing in a case where the print job is interrupted due to a cause of interruption, a selection unit configured to select, as a method of determining in which of the all-contact position and the partial-contact position, the shift unit is to position the belt member, a first determination method before a print job is interrupted, and select one of the first determination method and a second determination method, for recovery printing after interruption of the print job, a second obtaining unit configured to obtain information on the number of pages on which image formation is to be performed in recovery printing, and an estimation unit configured to estimate a total switching time period which is a total of time periods each estimated to be required to perform switching of the belt member between the all-contact position and the partial-contact position, during image formation to be performed on all the pages according to the first determination method in recovery printing, estimate a total recovery image formation time period which is a time period estimated to be required to perform image formation on all the pages when image formation is performed on all the pages according to the first determination method in recovery printing, and further estimate a time ratio of the total switching time period to the total recovery image formation time period, wherein the first determination method is a method of positioning the belt member in the all-contact position when an image of a page on which image formation is to be performed is a color image, and positioning the belt member in the partial-contact position when an image of a page on which image formation is to be performed is a monochrome image, wherein the second determination method is a method of positioning the belt member in the all-contact position for all pages on which image formation is to be performed, and wherein in recovery printing, in a case where the number of pages obtained by the second obtaining unit is not larger than a predetermined number, the selection unit selects the second determination method; in a case where the number of pages obtained by the second obtaining unit is larger than the predetermined number, and also the time ratio estimated by the estimation unit is not lower than a predetermined ratio, the selection unit selects the second determination method; and in cases other than the-above mentioned cases, the selection unit selects the first determination method.

According to the present invention, it is possible to properly reduce the recovery printing time, while reducing abrasion and deterioration of the image bearing members.

Further features of the present invention will become apparent from the following description of exemplary embodiments with reference to the attached drawings.

BRIEF DESCRIPTION OF THE DRAWINGS

FIGS. 3A and 3B are schematic diagrams showing the detailed arrangement of an image forming section and a transfer section, appearing in FIG. 1, in which FIG. 3A shows the image forming section and the transfer section in an all-contact mode, and FIG. 3B shows the same in a partial-contact mode.

FIGS. 12A to 12D are conceptual diagrams of information on the number of pages (FIGS. 12A and 12C) and color information of each page (FIGS. 12B and 12D).

FIG. 16B shows a case where a jam occurs in an early stage of processing of the job and recovery printing is executed, and FIG. 16C shows a case where a jam occurs in a stage near the end of the job and recovery printing is executed.

FIGS. 18A and 18B are conceptual diagrams each showing progression over time of processing of a print job in which color images and monochrome images are mixed, which is executed by an image forming apparatus according to a third embodiment of the present invention, in which FIG. 18A shows a case where the processing is normally executed without occurrence of a jam, and FIG. 18B shows a case where a jam occurs in an early stage of processing of the job and recovery printing is executed.

DESCRIPTION OF THE EMBODIMENTS

The present invention will now be described in detail below with reference to the accompanying drawings showing embodiments thereof.

Figure 1:
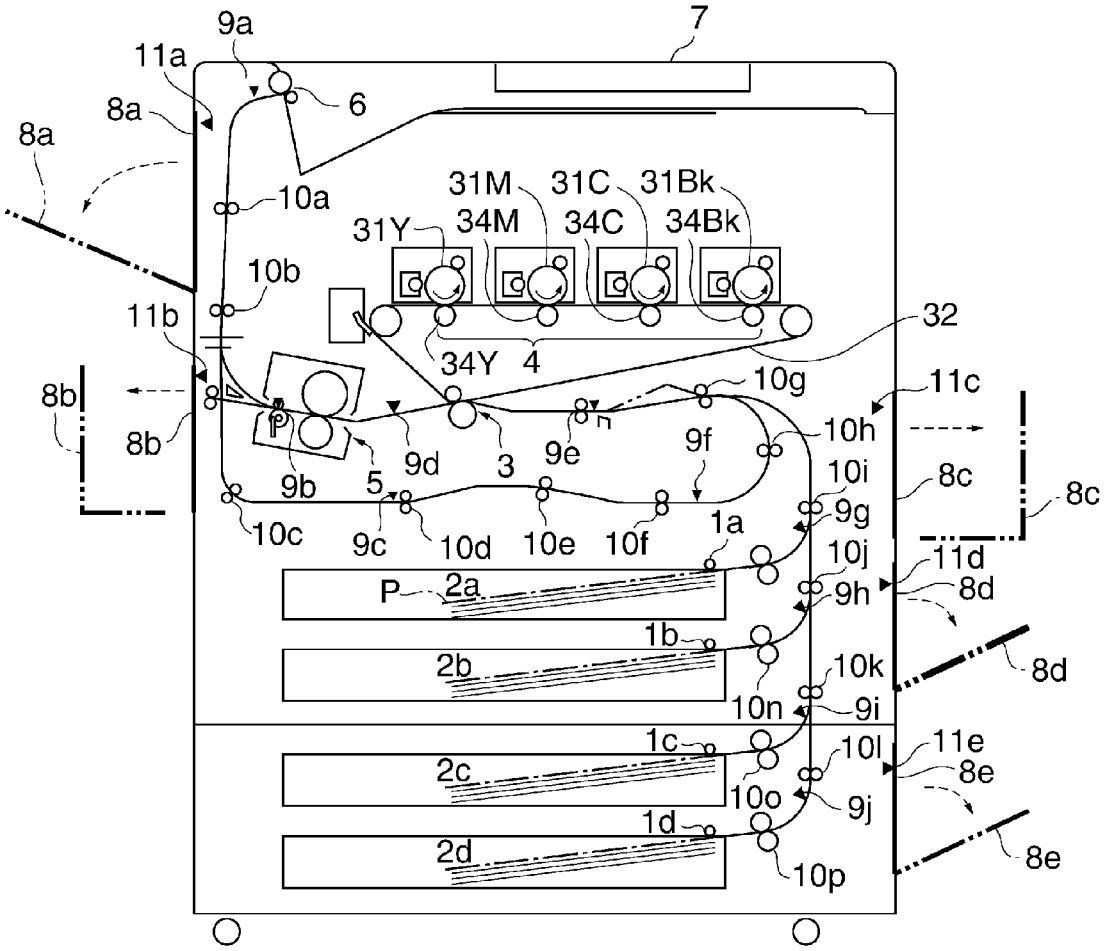
FIG. 1 is a cross-sectional view of an image forming apparatus according to a first embodiment of the present invention.

FIG. 1 is a cross-sectional view of an image forming apparatus according to a first embodiment of the present invention.

The image forming apparatus shown in FIG. 1 is a color image forming apparatus that forms an image of a plurality of colors using an electrophotographic process. First, a description will be given of an outline of the arrangement and operations of the present image forming apparatus.

Recording sheets P are fed from sheet feeders 2*a* to 2*d* by pickup rollers 1*a* to 1*d*, respectively. In an image forming section 4, toner images formed on photosensitive members 31 as image baring members are primarily transferred onto an intermediate transfer belt 32 which is a belt member, in a superimposed manner to form a toner image thereon, and the toner image on the intermediate transfer belt 32 is secondarily transferred onto a recording sheet P by a transfer section 3. Then, the toner image transferred onto the recording sheet P is heated and fixed by a fixing section 5, and then the recording sheet P is discharged from a sheet discharge section 6.

The image forming section 4 is provided with four photosensitive members 31 (31Y, 31M, 31C, and 31Bk), and transfer rollers 34 (34Y, 34M, 34C, and 34Bk) as transfer members associated with the respective photosensitive members 31. Each transfer roller 34 is opposed to the associated one of the photosensitive members 31. The photosensitive members 31Y, 31M, 31C, and 31Bk are those for yellow toner, magenta toner, cyan toner, and black toner, respectively. In the image forming section 4, an electrostatic latent image formed on each photosensitive member 31 is developed by an associated developing device, whereby toner images of the respective colors are formed on the respective photosensitive members 31.

The present image forming apparatus further includes an operation section 7 as a user interface. Arranged on conveying paths for conveying each recording sheet P are conveying rollers 10*a* to 10*p* for conveying the recording sheet P, and jam detection sensors 9 (9*a* to 9*j*) for detecting a paper jam (hereinafter referred to as a jam) of the recording sheet P. Out of the jam detection sensors 9, the sensor 9*a* also functions as a recording sheet discharge sensor for detecting completion of sheet discharge. Further, the sensor 9*e* also functions as a recording sheet leading edge detection sensor for aligning the position of an image formed by the image forming section 4 and the position of the recording sheet P in a direction of conveying a recording sheet P.

If processing of a print job is interrupted (operation of sheet feeding, image formation, fixing, or discharge is stopped) e.g. due to a jam, the user opens doors 8*a* to 8*e*, and removes the recording sheet P which remains within the apparatus for jam clearance processing. Then, the user closes the doors 8*a* to 8*e*, whereby the jam clearance processing is finished and the apparatus recovers from the print job-interrupted state and is enabled to start recovery printing. Opening/closing of the doors 8*a* to 8*e* by the user is detected by door open/close detection sensors 11*a* to 11*e*, respectively.

Note that in the present embodiment, an original image based on which image formation is performed using toner is an image read by an image reading section 222 (see FIG. 2) from each of originals in sheet form made separate one by one.

Figure 2:
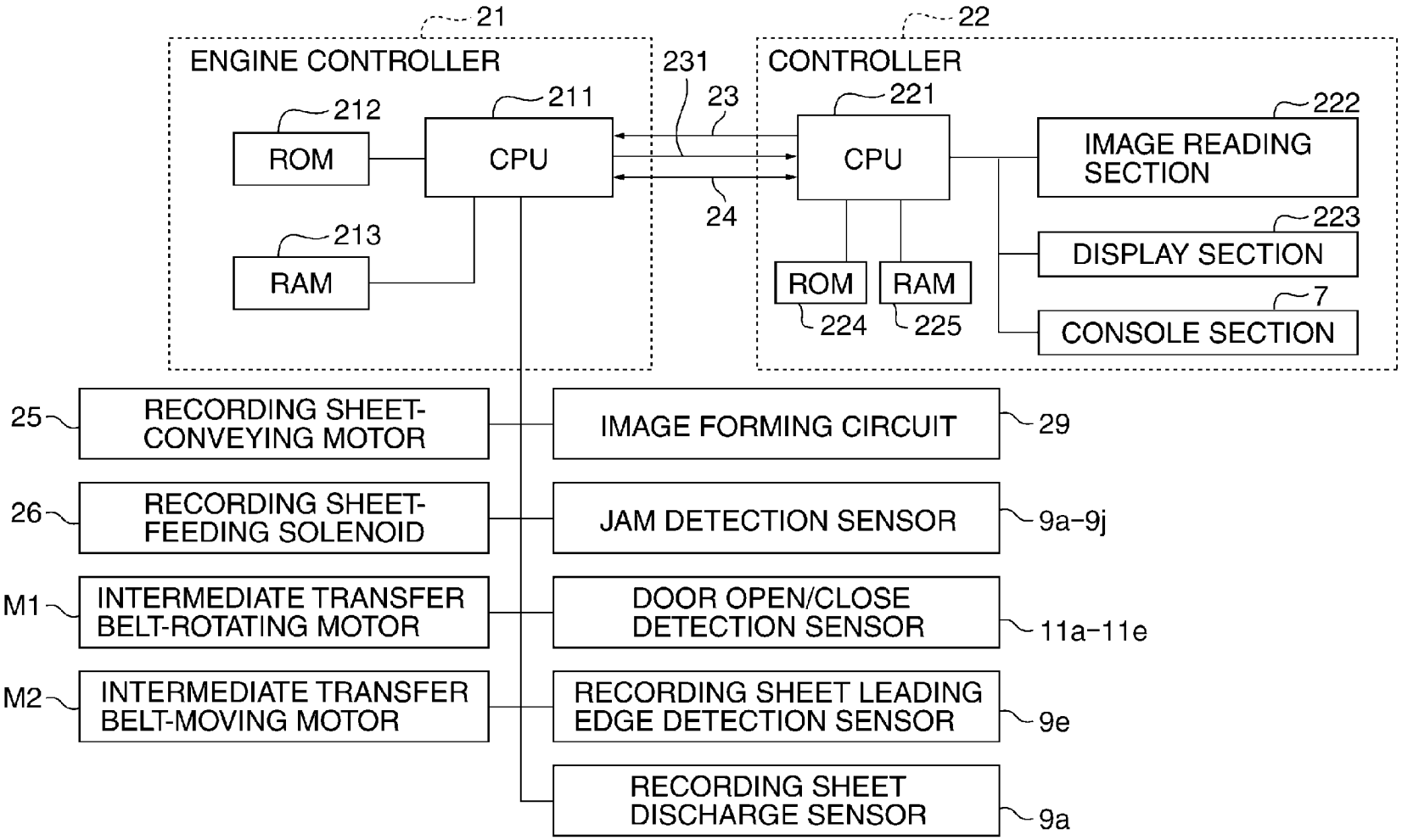
FIG. 2 is a control block diagram of the image forming apparatus shown in FIG. 1.

FIG. 2 is a control block diagram of the image forming apparatus shown in FIG. 1.

The image forming apparatus includes an engine controller 21 which controls an engine section of the image forming apparatus, and a controller 22 which controls a print job. The engine controller 21 includes an engine CPU 211 (hereinafter sometimes simply referred to as the "CPU 211") which is a central processing unit. The engine controller 21 further includes a ROM 212 that stores programs executed by the CPU 211 and a RAM 213 for storing various data used by the CPU 211 during execution of each program.

The controller 22 includes the image reading section 222 which reads an image, a display section 223 which displays the state of the apparatus to a user, and a controller CPU 221 (hereinafter sometimes simply referred to as the "CPU 221") which controls the image reading section 222 and the display section 223. The controller 22 further includes the operation section 7 (see FIG. 1) for operating the apparatus by the user, a ROM 224 that stores programs executed by the CPU 221, and a RAM 225 for storing various data used by the CPU 221 during execution of each program. The image reading section 222 includes a mechanism for making each of a plurality of set originals in sheet form separate from the rest, one by one, and thereby reading each original.

A communication path 24 is established between the CPU 221 and the CPU 211. A command for instructing the CPU 211 to perform printing operation is sent from the CPU 221 through the communication path 24. Further, a status signal for notifying the CPU 221 of the state of the engine (indicative of a printable state or an unprintable state e.g. caused by a jam) is also sent from the CPU 211 through the communication path 24.

Further, various information on a print job, such as color information of each page to be printed and information on the number of pages (see FIGS. 12A to 12D, referred to hereinafter, for both), is also sent from the CPU 221 to the CPU 211 through the communication path 24. A signal line 23 is used for sending image data from the CPU 221 to the CPU 211. Further, a signal line 231 is used for sending an image leading edge synchronization signal from the CPU 211 to the CPU 221, which is for aligning a leading edge of an image sent by data transmission and a leading edge of a recording sheet P. The CPU 221 monitors the image leading edge synchronization signal, and when the image leading edge synchronization signal is switched from off to on or from on to off, the CPU 221 recognizes this.

In the engine controller 21 and the controller 22, illustration and description of other devices which are not directly related to the present invention are omitted. Note that when a print job is interrupted by some cause of interruption, the CPU 221 and the CPU 211 cooperatively function as a recovery unit that performs recovery printing.

Connected to the CPU 211 are an intermediate transfer belt-rotating motor M1, an intermediate transfer belt-moving motor M2, the door open/close detection sensors 11*a* to 11*e*, a recording sheet-conveying motor 25, a recording sheet-feeding solenoid 26, and an image forming circuit 29. Further connected to the CPU 211 are the jam detection sensors 9*a* to 9*e* including the recording sheet discharge sensor 9*a* (separately shown) and the recording sheet leading edge detection sensor 9*e* (separately shown). Further, a fixing control circuit (not shown) for controlling the fixing section 5 (see FIG. 1) is connected to the CPU 211.

Torque of the recording sheet-conveying motor 25 is transmitted to the pickup rollers 1*a* to 1*d* by starting the recording sheet-feeding solenoid 26, and each recording sheet P is conveyed into the apparatus from one of the sheet feeders 2*a* to 2*d*.

The image forming circuit 29 controls the image forming section 4 and the transfer section 3. The image forming circuit 29 includes a motor circuit, not shown, for driving the photosensitive members (31Y, 31M, 31C) for color toner which are color image bearing members, and the photosensitive member (31Bk) for black toner which is a monochrome image bearing member, a high-voltage charging circuit, not shown, for forming an electrophotographic latent image, and a laser scanner drive circuit, not shown. The image forming circuit 29 further includes a high-voltage developing circuit, not shown, for forming a toner image from a latent image, and a high-voltage transfer circuit, not shown, for transferring a toner image.

The recording sheet leading edge detection sensor 9*e* is provided in the vicinity of an inlet of the image forming section 4, for detecting a leading edge of a recording sheet P being conveyed. When the recording sheet leading edge detection sensor 9*e* detects a position of the leading edge of the recording sheet P, the CPU 211 switches on the image leading edge synchronization signal transmitted to the CPU 221 through the signal line 231. The CPU 221 sends image data to the CPU 211 in synchronism with switching-on of the image leading edge synchronization signal, and thereby aligns the leading edge of an image represented by the sent image data and that of an image to be printed on the recording sheet P.

When the recording sheet P having the image transferred thereto is discharged from the sheet discharge section 6 after being fixed by the fixing section 5, completion of discharge of the recording sheet P is determined by detecting passage of a trailing edge of the recording sheet P by the recording sheet discharge sensor 9*a*. Then, the CPU 211 sends a discharge completion status indicative of completion of discharging the recording sheet P to the CPU 221.

Figure 3A:
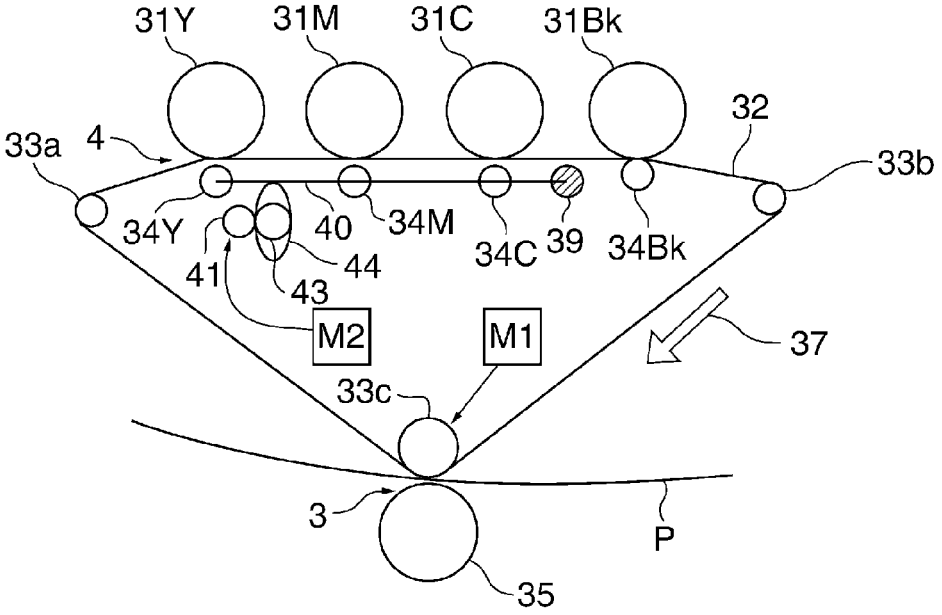
Figure 3B:
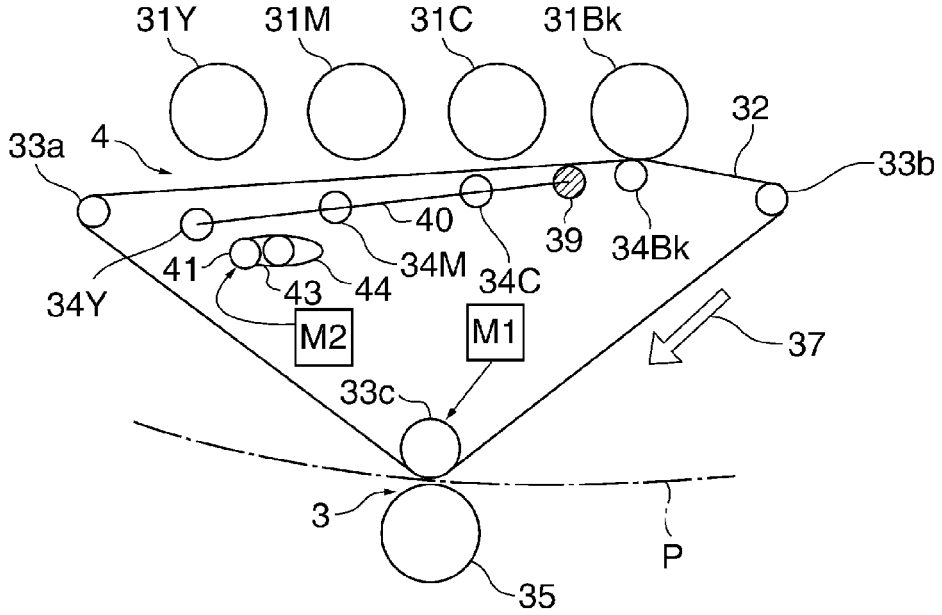

FIGS. 3A and 3B are schematic diagrams showing the detailed arrangement of the image forming section 4 and the transfer section 3, in which FIG. 3A shows the image forming section 4 and the transfer section 3 in an all-contact mode, and FIG. 3B shows the same in a partial-contact mode.

Note that the all-contact mode and the partial-contact mode are different in position of the intermediate transfer belt 32 relative to the photosensitive members (31Y, 31M, 31C) for color toner. The all-contact mode is a mode mainly for forming a color image, and the partial-contact mode is a mode for forming a monochrome image. When a color image is formed, the image formation mode is necessarily set to the all-contact mode. However, when a monochrome image is formed, although the image formation mode is usually set to the partial-contact mode, it is also possible to form a monochrome mode in the all-contact mode. When a monochrome image is formed in the all-contact mode, the operations for developing an image and so on are not performed for the photosensitive members (31Y, 31M, 31C) for color toner.

As mentioned above, in actuality, the all-contact mode and the partial-contact mode define the position of the intermediate transfer belt 32 for image formation. However, in the present embodiment, normally (unless a job is interrupted), the all-contact mode is selected for color image formation, and the partial-contact mode is selected for monochrome image formation, and hence these modes are collectively referred to as the "image formation mode" for convenience sake.

The intermediate transfer belt 32 is supported by support rollers 33*a* and 33*b*, and a rotation roller 33*c* of the transfer section 3, and the rotation roller 33*c* is driven by the intermediate transfer belt-rotating motor M1 to rotate the intermediate transfer belt 32 in a direction indicated by an arrow 37. The intermediate transfer belt 32 is rotated to move between the transfer rollers 34 and the photosensitive members 31.

In color image formation, toner images of the respective colors of yellow, magenta, cyan, and black, which are formed on the photosensitive members 31, respectively, are sequentially transferred onto the intermediate transfer belt 32 which is rotating, in a manner superimposed one upon another, whereby a color toner image is formed on the intermediate transfer belt 32. The color toner image formed on the intermediate transfer belt 32 is conveyed in a direction indicated by the arrow 37 along with rotation of the intermediate transfer belt 32, and is transferred onto the surface of a recording sheet P, which has been fed and conveyed from one of the sheet feeders 2*a* to 2*d*, by a transfer roller 35 of the transfer section 3.

In monochrome image formation, a black toner image formed on the photosensitive member 31Bk is transferred onto the intermediate transfer belt 32, and then, the toner image on the intermediate transfer belt 32 is transferred onto the surface of a recording sheet P.

As described above, processing for forming a toner image on at least one of the photosensitive members 31, primarily transferring the toner image(s) formed on the photosensitive member(s) 31 onto the intermediate transfer belt 32, and further, secondarily transferring the toner image transferred onto the intermediate transfer belt 32 onto the surface of a recording sheet P are performed according to a print job. These processing operations are collectively referred to as an image forming processing sequence.

In color image formation (see FIG. 3A), the intermediate transfer belt 32 is in contact not only with the photosensitive member for black toner (31Bk) but also with the three photosensitive members (31Y, 31M, 31C) for color toner as the color image bearing members. On the other hand, in monochrome image formation (see FIG. 3B), yellow toner, magenta toner, and cyan toner are not required for image formation. Therefore, although the intermediate transfer belt 32 is in contact with the photosensitive member for black toner (31Bk), the intermediate transfer belt 32 is not in contact with but is away from the photosensitive members (31Y, 31M, 31C) for color toner.

The arrangement and a control mechanism for moving the intermediate transfer belt 32 to and away from the photosensitive members (31Y, 31M, 31C) for color toner will be described.

The transfer rollers 34Y, 34M, and 34C are connected to a frame 40, and are each disposed in a manner rotatable relative to the frame 40. The frame 40 is connected to a pivot shaft 39, and is pivotally movable about the pivot shaft 39. Further, a cam 44 is disposed in a manner engageable with the frame 40.

A gear 43 is fixed to the cam 44 in a manner concentrically and integrally with the cam 44, and is meshed with a gear 41. The gear 41 is driven for rotation by the intermediate transfer belt-moving motor M2 as a shift unit to thereby rotate the gear 43, and the cam 44 is also rotated in unison with rotation of the gear 43. When the frame 40 is driven by the cam 44 in a manner being thrust upward, the frame 40 is pivoted clockwise as viewed in FIG. 3A to be moved up, and when the cam 44 is displaced in a retreating direction, the frame 40 is pivoted anticlockwise as viewed in FIG. 3B by a weight thereof or a force of an urging member, not shown, to be moved down.

The transfer rollers 34Y, 34M, and 34C are displaced along with displacement of the frame 40. That is, when the frame 40 is moved up or down, the transfer rollers 34Y, 34M, and 34C connected to the frame 40 are similarly moved up or down. Portions of the intermediate transfer belt 32, which are sandwiched between the transfer rollers 34Y, 34M, and 34C and the photosensitive members 31Y, 31M, and 31C, respectively, are brought into contact with or moved away from the photosensitive members 31Y, 31M, and 31C by upward or downward movement of the transfer rollers 34Y, 34M, and 34C.

In the all-contact mode (see FIG. 3A), the intermediate transfer belt 32 is in contact with all of the four photosensitive members 31, and the position of the intermediate transfer belt 32 at this time is referred to as the "all-contact position". In the partial-contact mode (see FIG. 3B), the intermediate transfer belt 32 is in contact only with the photosensitive member (31Bk) for black toner which is part of the image bearing members, and the position of the intermediate transfer belt 32 at this time is referred to as the "partial-contact position".

However, the mechanism for bringing the intermediate transfer belt 32 into contact with or moving the same away from the photosensitive members (31Y, 31M, 31C) for color toner is not limited to the illustrated example of the cam mechanism illustrated in FIGS. 3A and 3B. Any other mechanism can be employed insofar as it can shift the intermediate transfer belt 32 to thereby switch the position of the intermediate transfer belt 32 relative to the photosensitive members (31Y, 31M, 31C) for color toner between the all-contact position and the partial-contact position.

As is clear from FIGS. 3A and 3B, to switch the image formation mode between the all-contact mode and the partial-contact mode, it is necessary to shift the intermediate transfer belt 32, which requires time for the movement of the intermediate transfer belt 32.

Figure 4:
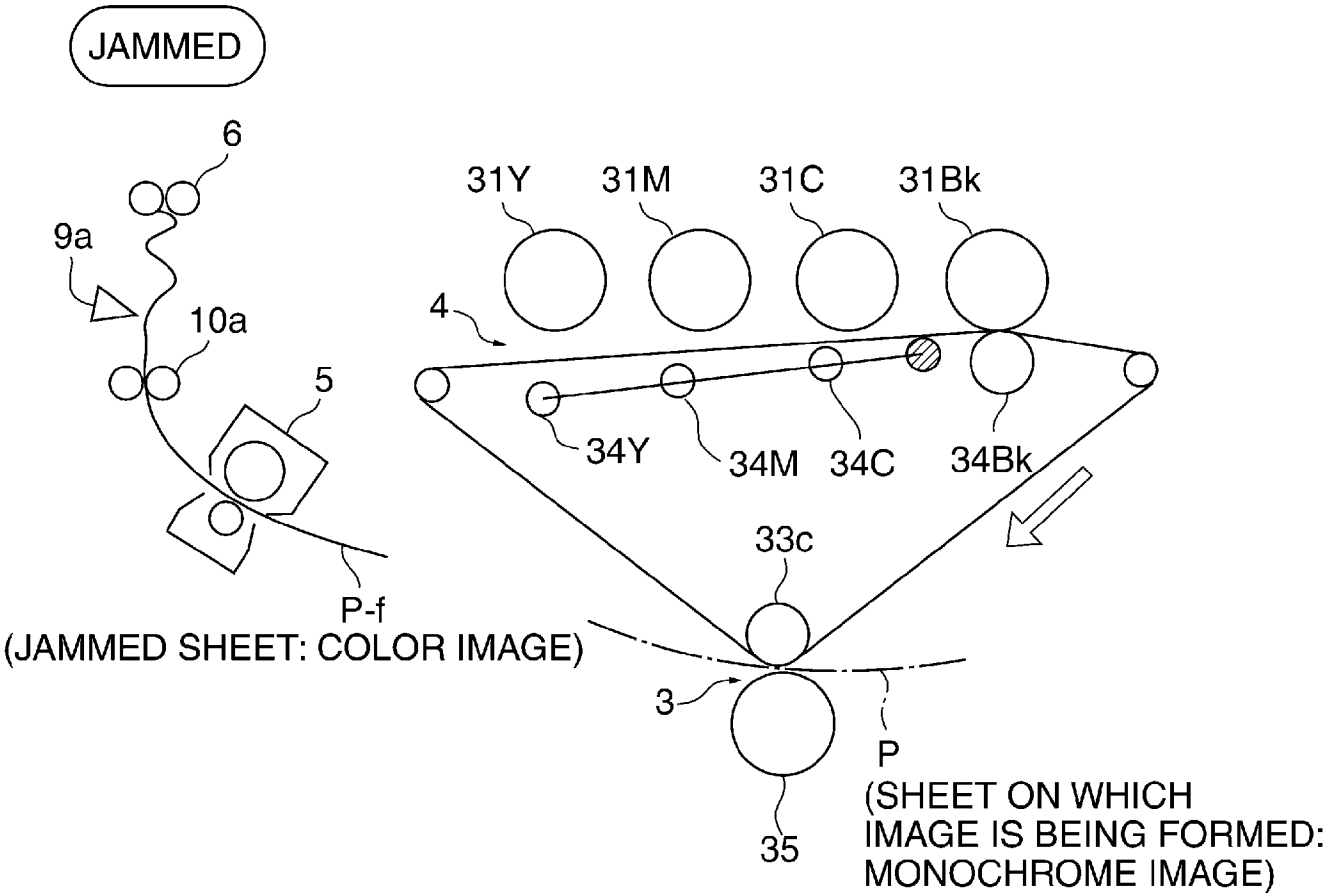
FIG. 4 is a diagram showing a situation in which a jam has occurred at a fixing section during continuous printing, causing interruption of printing and stoppage of operation of the apparatus.

FIG. 4 is a diagram showing a situation in which a jam has occurred at the fixing section 5 during continuous printing, causing interruption of printing and stoppage of operation of the apparatus. Particularly, FIG. 4 shows a situation in which the image forming section 4 and the transfer section 3 are forming a monochrome image when the apparatus is stopped, and an image on a recording sheet P which is jammed (jammed sheet P-f) at the fixing section 5 is a color image.

Since the apparatus is stopped due to the jam during monochrome image formation, the intermediate transfer belt 32 is stopped in the partial-contact position in which it is away from the photosensitive members (31Y, 31M, 31C) for color toner. After the jammed sheet P-f is removed from the apparatus by the user (jam clearance processing), cleaning of each of the photosensitive members 31 and the intermediate transfer belt 32 and so forth are performed, whereby the apparatus returns to a printable state again. After the apparatus has returned to the printable state, recovery printing is carried out.

For example, in the case where the apparatus is stopped in the situation shown in FIG. 4, if the recording sheets P preceding the jammed sheet P-f have all been normally discharged, the first page for recovery printing is a page of which the image is to be transferred onto the jammed sheet P-f. In other words, the image for the first page to be subjected to image formation in recovery printing is a color image.

Figure 5:
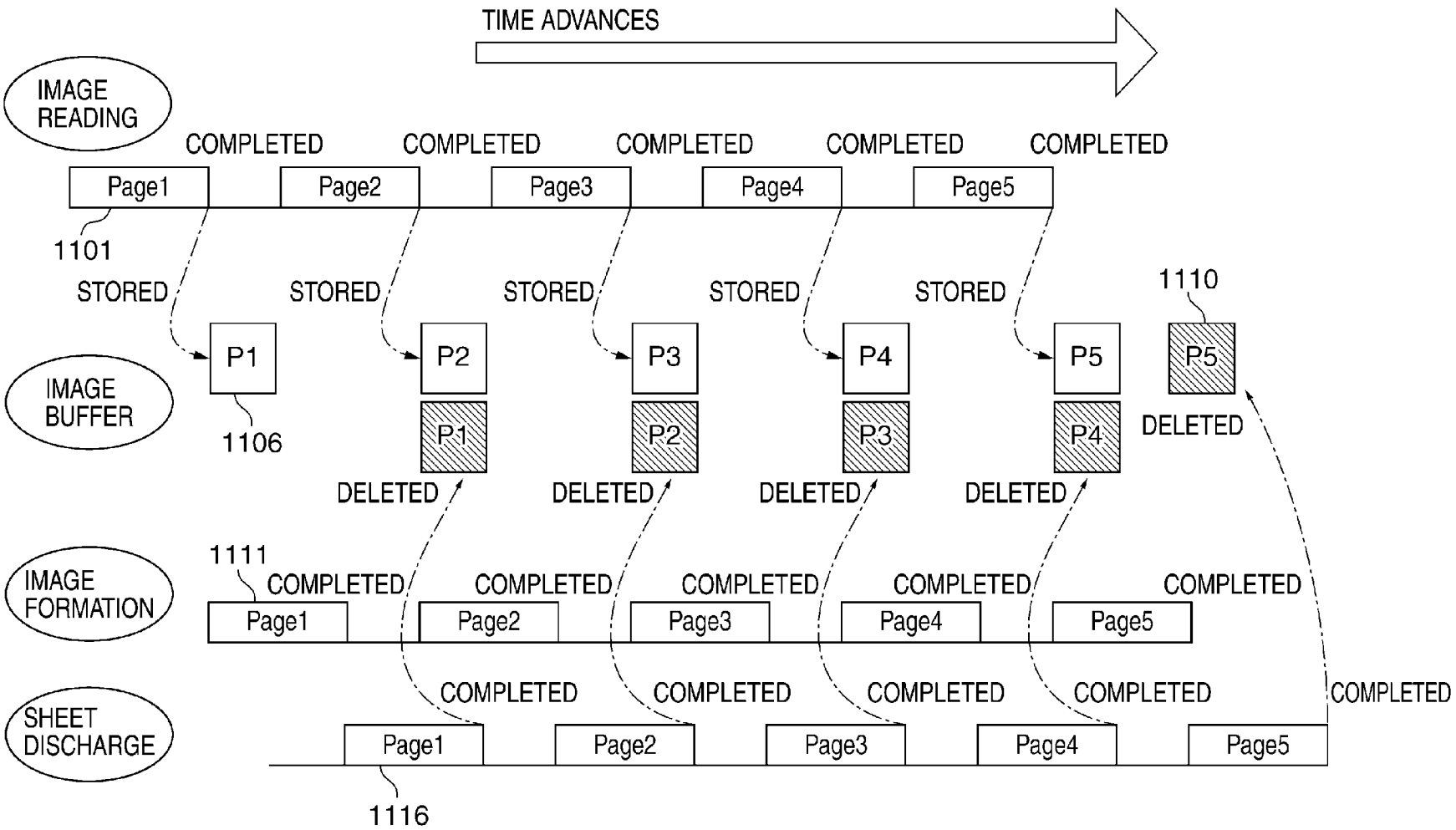
FIG. 5 is a diagram showing a sequence of operations from image reading to sheet discharge.

FIG. 5 is a diagram showing a sequence of operations from image reading to sheet discharge.

In the controller 22, an image read by the image reading section 222 is stored in an image buffer allocated in the RAM 225, and then is sent to the engine controller 21. The image sent to the engine controller 21 is formed on the recording sheet P by image formation processing and fixing processing, and the recording sheet P is discharged.

Although read images (image data items) are sequentially stored in the image buffer by the CPU 221, when each recording sheet P is normally discharged after an associated image has been formed thereon, each corresponding image data item is sequentially deleted from the image buffer by the CPU 221.

For example, when Page 1 (1101) as a first page of the sheets has been read, the read image is stored as an image (data item) P1 (1106) in the image buffer by the CPU 221. The image (data item) P1 is sent to the engine controller 21 by the CPU 221, and is formed as Page 1 (1111).

The image which has been formed (image on the recording sheet P) is discharged as Page 1 (1116), and when Page 1 has been discharged, the image (data item) P1 (1106) stored in the image buffer is deleted from the image buffer by the CPU 221. Similarly, for each of the following Page 2 to Page 5, there are sequentially executed respective steps of reading an image, storing the image in the image buffer, forming the image, discharging the recording sheet, and deleting the image.

Figure 6:
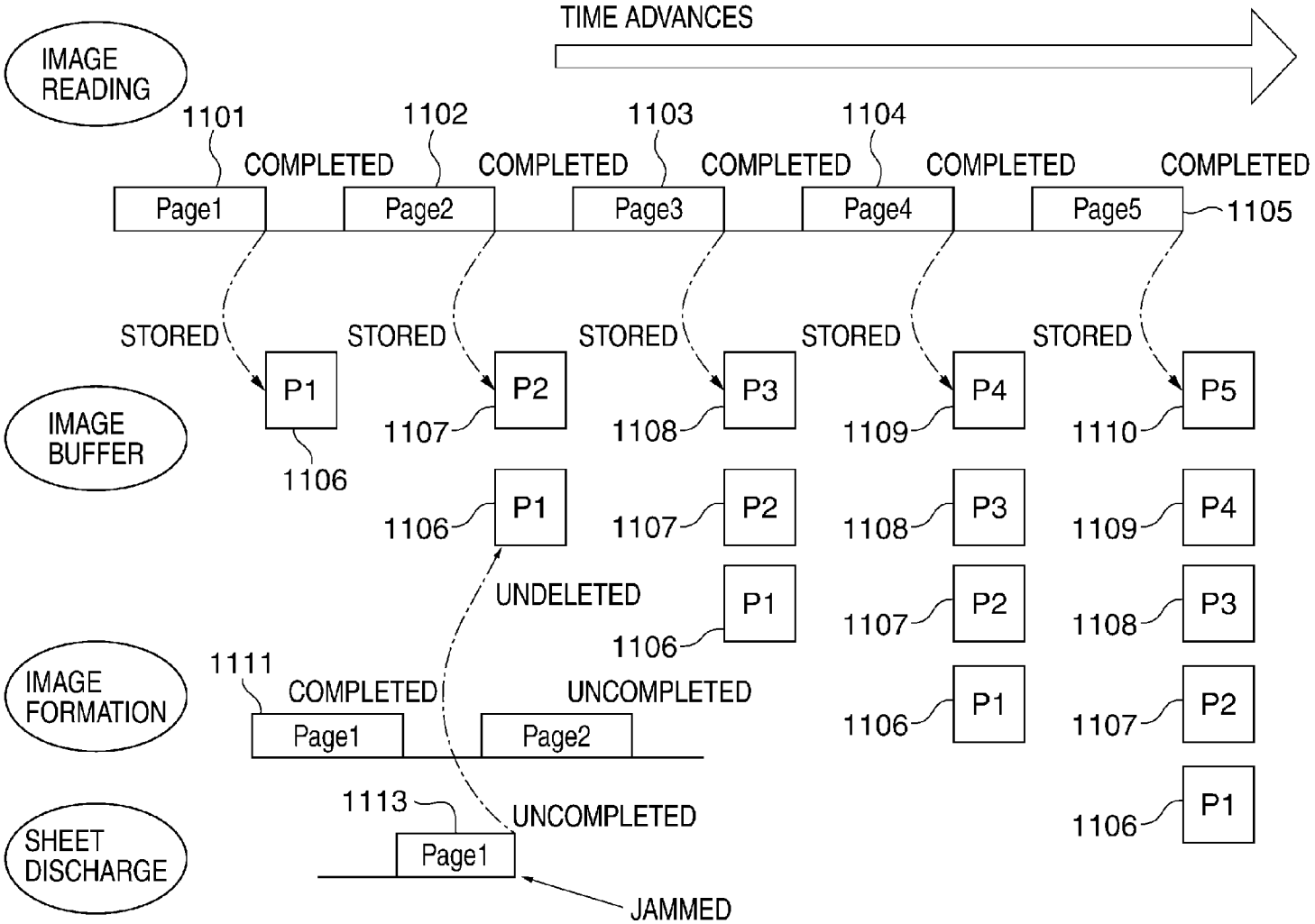
FIG. 6 is a diagram showing the sequence of operations from image reading to sheet discharge in a case where a recording sheet is jammed during discharge of the recording sheet.

FIG. 6 is a diagram showing the sequence of operations from image reading to sheet discharge in a case where a recording sheet P is jammed during discharge of the recording sheet.

Similarly to FIG. 5, Page 1 (1101) is read and stored as the image (data item) P1 (1106) in the image buffer, and the image (data item) P1 (1106) is sent to the engine controller 21, whereby the image is formed as Page 1 (1111).

After the image formation of Page 1 (1111) has been completed, the processing of Page 1 shifts to discharge processing. However, a recording sheet of Page 1 (1113) is jammed in the step of sheet discharge, so that the discharge operation is not completed. In this example, more specifically, a case is assumed where the recording sheet P cannot be removed from the position of the recording sheet discharge sensor 9*a*.

Although the image forming section 4 of the image forming apparatus is stopped due to the jam, the image reading unit 222 of the controller 22 continues the image reading operation. Therefore, an image (data item) read from Page 2 (1102) is stored as P2 (1107) in the image buffer by the CPU 221. The image (data item) P1 (1106) having been stored before storing the image (data item) P2 remains in the image buffer without being deleted from the image buffer, because the recording sheet P having the image P1 formed thereon has not been discharged.

Thereafter, images are sequentially read at the timings of Page 3 (1103), Page 4 (1104), and Page 5 (1105). These read images (data items) are stored as P3 (1108), P4 (1109), and P5 (1110) in the image buffer by the CPU 221. Finally, all of the images P1 to P5 remain in the image buffer.

In the present embodiment, there are two methods for determining which of the all-contact mode and the partial-contact mode is to be selected for the image formation mode that defines the position of the intermediate transfer belt 32 during image formation. As described hereafter, one of these two methods is selected according to the situation by the CPU 211.

The above-mentioned two methods are a first image formation mode-determining method (abbreviated to the first determination method) and a second image formation mode-determining method (abbreviated to the second determination method).

In the first determination method, the image formation mode is set to the all-contact mode or the partial-contact mode depending on whether an image for a page on which image formation is to be performed is a color image or a monochrome image, respectively. For example, this first determination method is selected until image formation is interrupted e.g. due to a jam during continuous printing.

In the second determination method, the image formation mode is set to the all-contact mode for all pages on which image formation is to be performed. In recovery printing after clearing a jam, the first determination method or the second determination method is selected, and for example, the selection is determined depending on whether or not at least one page of color image is included in the pages on which image formation is to be performed.

The second determination method has an effect of accelerating the speed of recovery printing, and hence when the second determination method is selected, a recovery accelerating flag, referred to hereinafter, is set to 1. On the other hand, when the first determination method is selected, the recovery accelerating flag is set to 0.

Figure 7:
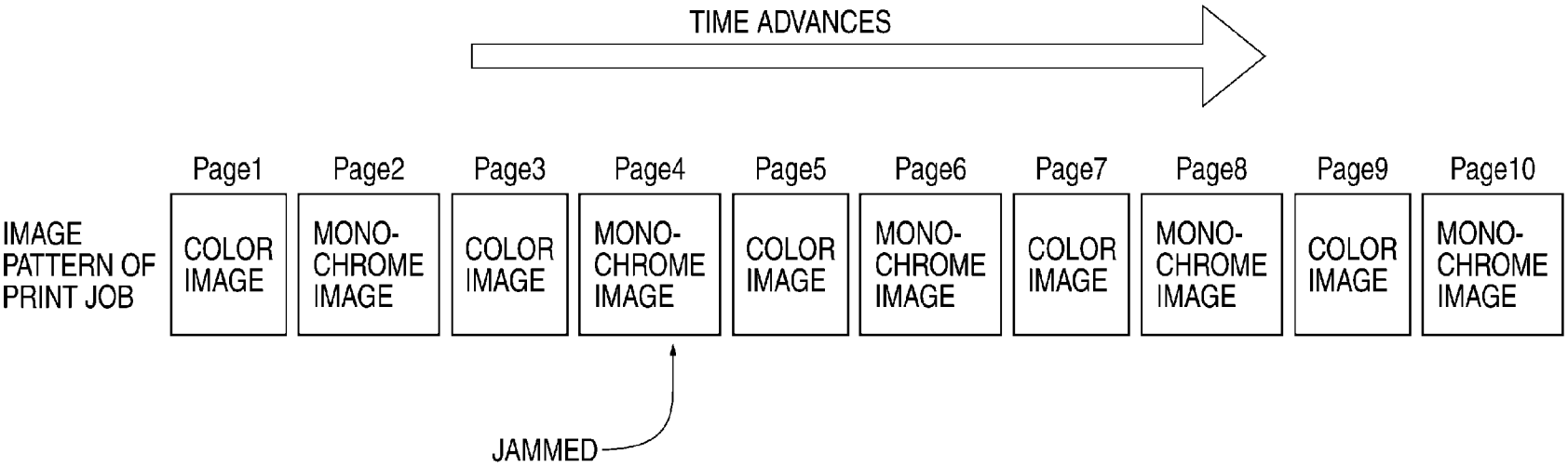
FIG. 7 is a conceptual diagram showing progression over time of processing of a print job in which color images and monochrome images are mixed.

FIG. 7 is a conceptual diagram showing progression over time of processing of a print job in which color images and monochrome images are mixed.

The print job, shown in FIG. 7, for printing ten pages of Page 1 to Page 10 has a mixed pattern in which color pages and monochrome pages alternately appear in such a manner that Pages 1, 2, and 3 are a color page, a monochrome page, and a color page, respectively, for example. Assuming that a sheet is jammed for Page 4 of these pages, then, the first page for recovery printing is Page 4.

Figure 8:
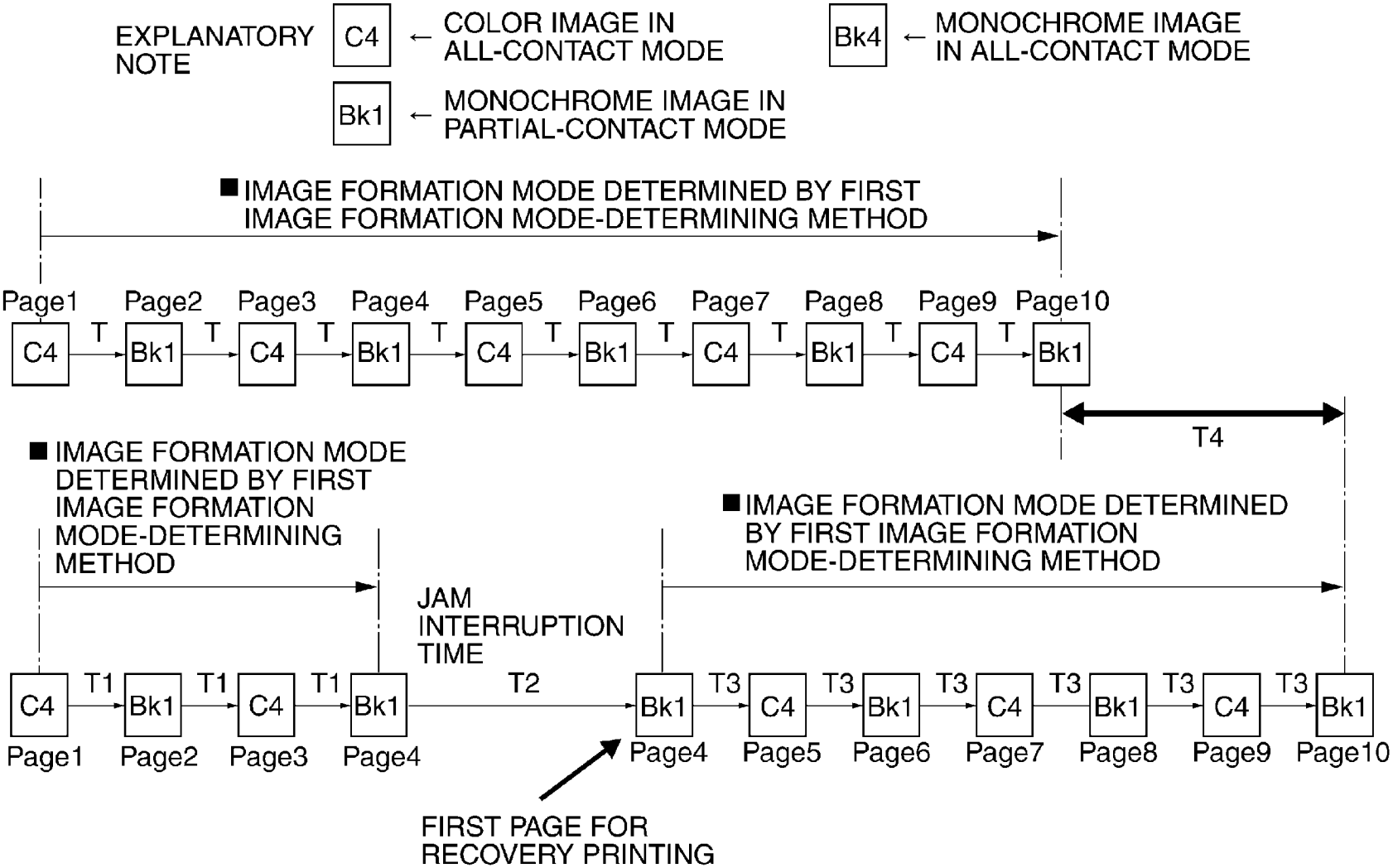
FIG. 8 is a diagram showing progression over time of processing of the print job, for comparison between processing time required when job interruption occurs and processing time required when job interruption does not occur, in a case where the print job shown in FIG. 7 is processed by selecting a first determination method alone.

FIG. 8 is a diagram showing progression over time of processing of the print job, for comparison between processing time required when job interruption occurs and processing time required when job interruption does not occur, in a case where the print job shown in FIG. 7 is processed by selecting a first determination method alone.

An upper line in FIG. 8 shows progression over time of processing of a print job in the case where the print job in FIG. 7 is completed without being interrupted by a jam. The method of determining the image formation mode is set to the first determination method up to the end because the job is not interrupted.

In FIG. 8, "C4" indicates a color page on which image formation is to be performed in the all-contact mode, and "Bk1" indicates a monochrome page on which image formation is to be performed in the partial-contact mode. As shown in the upper line in FIG. 8, when the image formation mode is switched from C4 to Bk1, it takes a time period T as a mode switching time period. Further, also when the image formation mode is switched from Bk1 to C4, it similarly takes the time period T as the mode switching time period. As mentioned above, it may be considered that the mode switching time period is equal between the case of a change from C4 to Bk1 and the case of a change from Bk1 to C4.

A lower line in FIG. 8 shows progression over time of processing of the print job in the case where a sheet for Page 4 is jammed during execution of the print job shown in FIG. 7, and recovery printing is started from Page 4 after clearing the jam by the user. Further, it is assumed that the first determination method is selected as the image formation mode-determining method for recovery printing.

As shown in the lower line in FIG. 8, for Page 1 to Page 4, the image formation mode is determined by the first determination method because no jam has occurred, and progression from Page 1 to Page 4 in the lower line is the same as that from Page 1 to Page 4 in the upper line in FIG. 8. Therefore, the mode switching time period T1 before occurrence of a jam is equal to the mode switching time period T.

When a jam occurs at Page 4, recovery printing is started from Page 4 after the elapse of a jam interruption time period T2 for clearing the jam by the user. It is assumed in this example that the first determination method is selected also for Page 4 to Page 10, and hence progression over time of the print job from Page 4 to Page 10 is the same as that in a case where printing is completed without being interrupted by a jam. Therefore, progression over time of the print job from Page 4 to Page 10 in the lower line in FIG. 8 is the same as that from Page 4 to Page 10 in the upper line. More specifically, a mode switching time period T3 taken for each of switching operations from Page 4 to Page 10 in the lower line in FIG. 8 is equal to the mode switching time period T in the upper line in FIG. 8. Therefore, it is known that a total of mode switching time periods for recovery printing is equal to a total of mode switching time periods from Page 4 to Page 10 in the upper line in FIG. 8.

In the case of the lower line in FIG. 8, a time period required from the start of printing to the completion of recovery printing includes a time period lost due to interruption caused by a jam which occurred in the course of progression of the processing (jam interruption time period T2), and hence is longer than the case (upper line) where printing is completed without being interrupted by the jam, by a time period T4. The time period T4 is equal to the time lost due to interruption caused by the jam (jam interruption time period T2).

That is, in the case where the first determination method is selected from the start to the end of the print job, if the job is interrupted, the final print finishing time is delayed by a time period corresponding to the time lost due to the interruption.

Figure 9:
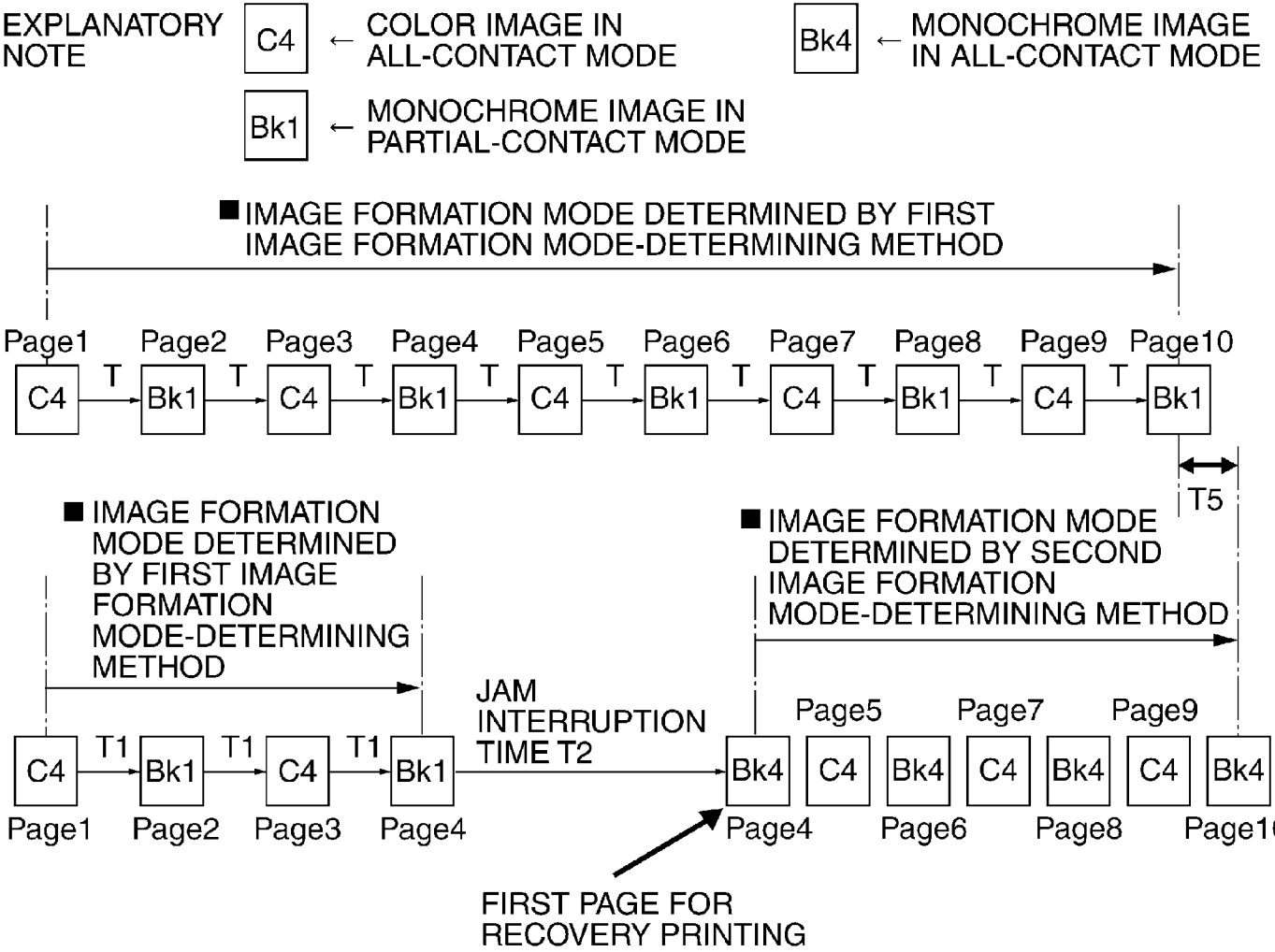
FIG. 9 is a diagram showing progression over time of processing of the print job, for comparison between processing time required when job interruption occurs and processing time required when job interruption does not occur, in a case where a second determination method is selected for recovery printing during processing of the print job shown in FIG. 7.

FIG. 9 is a diagram showing progression over time of processing of the print job, for comparison between processing time required when job interruption occurs and processing time required when job interruption does not occur, in a case where the second determination method is selected for recovery printing during processing of the print job shown in FIG. 7. In FIG. 9, "Bk4" indicates a monochrome page on which image formation is performed in the all-contact mode.

An upper line in FIG. 9 is the same as the upper line in FIG. 8, and shows progression over time of processing of the print job in the case where the print job is completed without being interrupted by a jam. The first determination method is selected as the image formation mode-determining method up to the end.

A lower line in FIG. 9 shows progression over time of processing of the print job in a case where the second determination method is selected as the image formation mode-determining method for recovery printing. In the second determination method selected in this example, specifically, if at least one page of color image is included in the pages to be printed by recovery printing (Page 4 to Page 10), the image formation mode is set to the all-contact mode from the start to the end of recovery printing.

As shown in the lower line in FIG. 9, the progression of processing from Page 1 to Page 4 is the same as that in the lower line in FIG. 8. In the illustrated example in FIG. 9, Page 5, Page 7, and Page 9 are color pages, which means that at least one page of color image is included. Therefore, in recovery printing after job interruption due to the jam, the image formation mode is set to the all-contact mode by the second determination method. Therefore, although Page 4, which is the first page for recovery printing, is a monochrome image, the image formation processing is performed in the all-contact mode (Bk4).

All pages following Page 4 are subjected to image formation in the all-contact mode, and hence a mode switching time period during recovery printing is not produced and is equal to "0". When a total time period from the start to the end of printing for the print job is compared, the total time period required for the processing in the lower line in FIG. 9 is longer than that in the upper line in FIG. 9 by a time period T5. The extra time period T5 is much smaller than the extra time period in the example of the lower line in FIG. 8 (time period T4), and this indicates that the time period lost due to interruption caused by the jam is largely recovered.

Now, let us examine an example of recovered time. The image formation mode is switched six times during recovery printing in the lower line in FIG. 8. It is assumed here that the mode switching time period T per one mode switching is five seconds. From the above, the total of mode switching time periods during recovery printing in the lower line in FIG. 8 is T (five seconds)×the number of times of mode switching (six)=30 seconds. Further, assuming that the number of sheets to be printed in recovery printing is not seven pages, but 50 pages, the total of mode switching time periods is T (five seconds)×the number of times of mode switching (49)=245 seconds. This means that as much as more than four minutes is recovered.

Next, a detailed description will be given of a control process for the print job described as above, using a flowchart.

Figure 10:
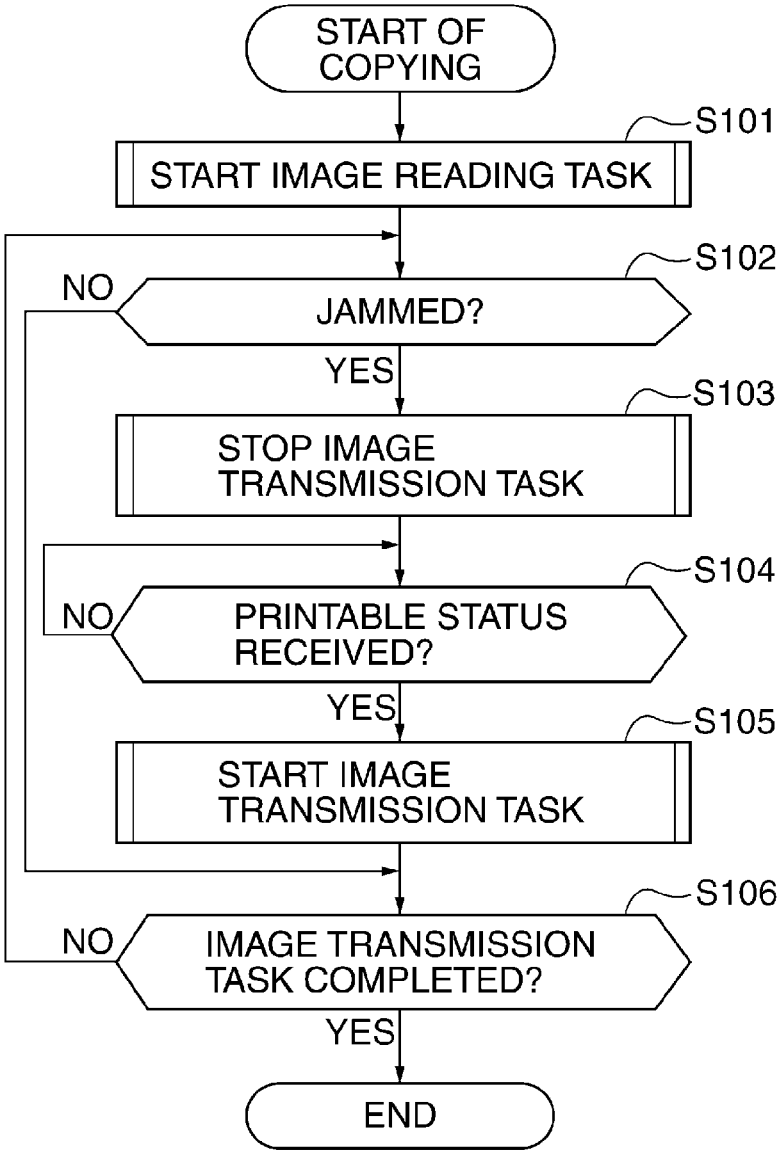
FIG. 10 is a main flowchart of a copy process.
Figure 11A:
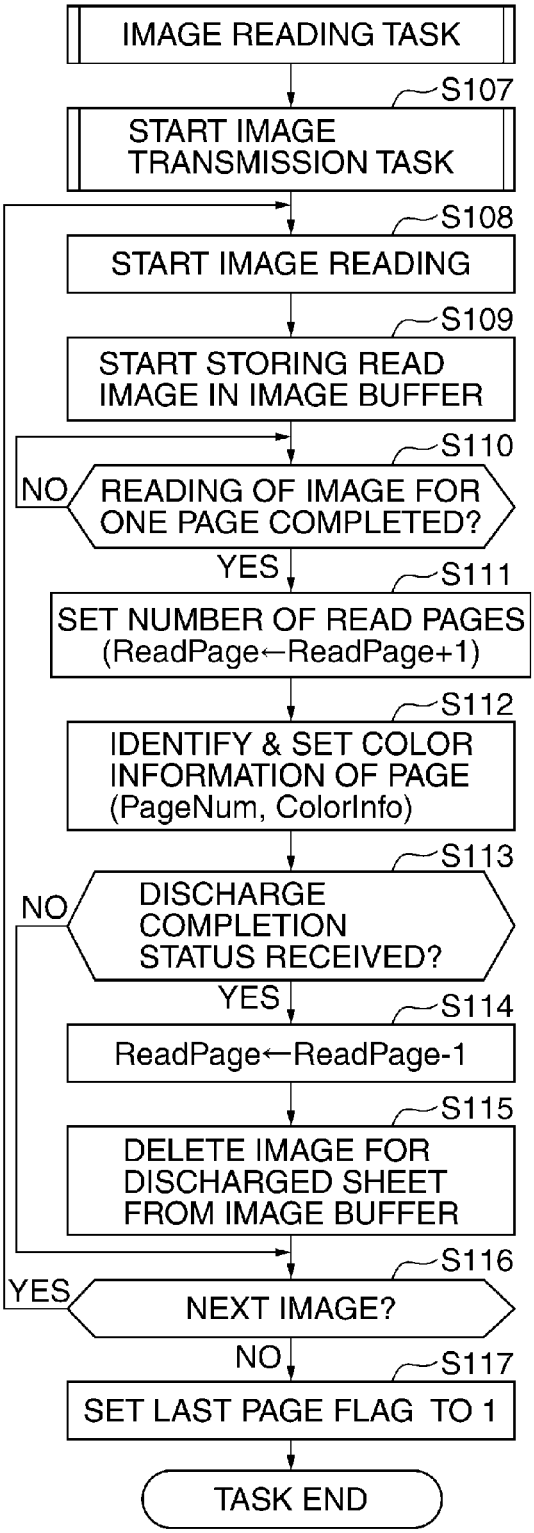
FIG. 11A is a flowchart of an image reading task process started in a step in the copy process in FIG. 10.
Figure 11B:
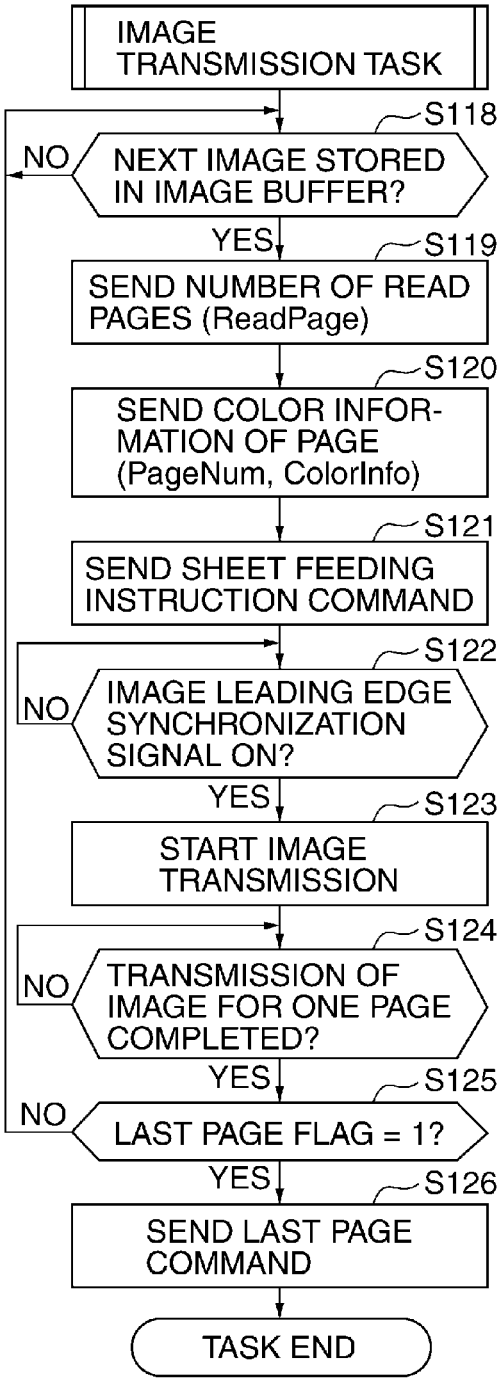
FIG. 11B is a flowchart of an image transmission task process started in a step in the copy process in FIG. 10.

FIGS. 10, 11A, and 11B are flowcharts of the control process executed by the controller CPU 221. Processing operations in respective steps in each control process are operations executed by the CPU 221 according to a program (multitasking) stored in the ROM 224 in the controller 22.

FIG. 10 is a main flowchart of a copy process, in which steps including those for starting an image reading task process and stopping and starting an image transmission task process are executed. FIG. 11A is a flowchart of the image reading task process, in which steps including those for starting the image transmission task process and controlling image reading are executed. FIG. 11B is a flowchart of the image transmission task process, in which steps including those for transmitting an image to the engine controller 21 are executed. In the control processes according to the above three flowcharts, although the copy process starts the image reading task process, and the image reading task process starts the image transmission task process, the respective processes are executed in parallel with each other. Hereafter, the processes will be described step by step.

First, in a step S101 in FIG. 10, the CPU 221 starts the image reading task process in FIG. 11A. When the image reading task process is started, in a step S107 in FIG. 11A, the CPU 221 starts the image transmission task process in FIG. 11B. When the image transmission task process is started, in a step S118 in FIG. 11B, the CPU 221 determines whether or not there is a next image (data item) stored in the image buffer. Therefore, the CPU 221 waits until an image for one page is stored in the image buffer, i.e. waits until a register ReadPage indicating the number of pages having been read ceases to be 0. FIG. 12A shows the register ReadPage.

Storage of the read image into the image buffer is executed by the image reading task process in FIG. 11A. After starting the image transmission task process in the step S107, the CPU 221 starts image reading in a step S108, and starts to store the read image (data item) in the image buffer in a step S109.

Next, in a step S110, the CPU 221 waits until reading of an image for one page is completed, and when the image for one page has been read, in a step S111, the CPU 221 increments the value of the register ReadPage by one. Note that the value of the register ReadPage is updated by being increased in the step S111 and being decreased in a step S114, referred to hereinafter (see also FIGS. 12A and 12C). Next, in a step S112, the CPU 221 sets the color information (information indicative of whether the page is a color page or a monochrome page) of the read page.

A register for setting the color information, shown in FIG. 12B, is formed by a combination of two information items of a page number (PageNum) and color information (ColorInfo) associated with the page number. If an image is a color image, a value indicative of the color information is set to 1, whereas if an image is a monochrome image, the same is set to 0.

After the value of 1 is set in ReadPage, in response thereto, in the image transmission task in FIG. 11B, the CPU 221 transmits the image stored in the image buffer to the engine controller 21. However, before that, the CPU 221 sends the number of read pages (ReadPage) and the color information of each page (PageNum and ColorInfo) to the engine controller 21 in respective steps S119 and S120. The number of read pages (ReadPage) sent here is the latest information. Further, the color information of the page (PageNum and ColorInfo) sent here is the color information of the page associated with the image to be sent this time.

Next, in a step S121, the CPU 221 sends a sheet feeding instruction command to the engine controller 21 to thereby instruct the engine controller 21 to feed a sheet. Since the image leading edge synchronization signal from the engine controller 21 is configured to be switched on when the leading edge of a recording sheet P fed in response to the sheet feeding instruction command reaches the recording sheet leading edge detection sensor 9*e*, the CPU 221 waits for the image leading edge synchronization signal to be switched on in a step S122. Then, after the image leading edge synchronization signal is switched on, the CPU 221 starts to transmit the image (data item) to the engine controller 21 in a step S123.

Next, the CPU 221 waits until the image transmission for one page is completed in a step S124, and when the image has been transmitted, the CPU 221 determines whether or not a last page flag is equal to 1 in a step S125. If the last page flag is not equal to 1, the CPU 221 returns to the step S118, wherein the CPU 221 waits until an image for a next page is stored in the image buffer again. The last page flag is set to 1 in a step S117 in FIG. 11A, referred to hereinafter, and the last page flag being equal to 1 indicates that the final one of the originals to be read has been read.

Referring again to FIG. 11A, after execution of the step S112, in a step S113, the CPU 221 determines whether or not a discharge completion status sent from the engine controller 21 has been received. If a discharge completion status has not been received, the CPU 221 proceeds to a step S116. On the other hand, if a discharge completion status has been received, this indicates that one page has been discharged, and hence the CPU 221 decrements the value of the register ReadPage by one in the step S114. Further, in a step S115, the CPU 221 deletes the data item of the image formed on the page which has been discharged, from the image buffer. At this time, the CPU 221 counts the discharged page so as to be aware of which page in the sequence of pages in the print job has been discharged this time and stores the count in the RAM 213.

Next, in the step S116, the CPU 221 determines whether or not there is a next original to be read, and if there is a next original, the CPU 221 returns to the step S108, wherein the CPU 221 proceeds to the starting of image reading again. On the other hand, if there is no next original, the CPU 221 sets the last page flag to 1 to thereby terminate the present task in the step S117.

If it is determined in the step S125 in FIG. 11B that the last page flag is equal to 1, the CPU 221 sends a last page command to the engine controller 21 in a step S126, followed by terminating the present task.

Next, a description will be give of a step S102 et seq. in FIG. 10 executed in a case where the recording sheet P is jammed during alternate execution of image reading and image transmission by the tasks described with reference to FIGS. 11A and 11B.

In the step S102 in FIG. 10, the CPU 221 determines whether or not a jam has occurred by determining whether or not a jam occurrence status (signal) (which is sent from the CPU 211 in a step S218 in FIG. 13A) has been received. If a jam has not occurred, the CPU 221 proceeds to a step S106. On the other hand, if a jam occurs, the CPU 221 interrupts the image transmission task in FIG. 11B in a step S103. The interrupted image transmission task does not transmit any image thereafter.

Next, in a step S104, the CPU 221 determines whether or not a printable status (signal) has been received. The printable status indicates that the jam clearance processing by the use has been completed and the apparatus is enabled to perform print processing again, and is sent from the engine controller 21 in a step S220 in FIG. 13A, referred to hereinafter.

Upon receipt of the printable status, since the apparatus is enabled to perform print processing, the CPU 221 starts the interrupted image transmission task (see FIG. 11B) again in a step S105. The restarted image transmission task starts recovery printing.

Here, even during interruption of the job and stoppage of the apparatus, caused by a jam, the image reading task (see FIG. 11A) continues to operate. Therefore, the CPU 221 continues processing for reading each of the remaining originals to be read and storing an image of each read original in the image buffer according to the image reading task process in FIG. 11A. By thus continuing the operation, the information on the number of read pages and color information are also updated and accumulated in the steps S111 and S112.

The final updated information on the number of pages is shown in FIG. 12C, by way example, and the final color information of each page is shown in FIG. 12D, by way of example. These information items are sent from the CPU 221 to the engine controller 21 in the steps S119 and S120 in FIG. 11B after jam clearance processing.

Next, control operations performed by the engine controller 21 under the control of the controller 22, described with reference to FIGS. 10, 11A and 11B, will be described with reference to FIGS. 13A, and 13B to 15.

All of FIGS. 13A, and 13B to 15 show control processes executed by the CPU 211 of the engine controller 21. Processing operations in respective steps in each control process are operations executed by the CPU 211 according to a program (multitasking) stored in the ROM 212 in the engine controller 21.

Figure 13A:
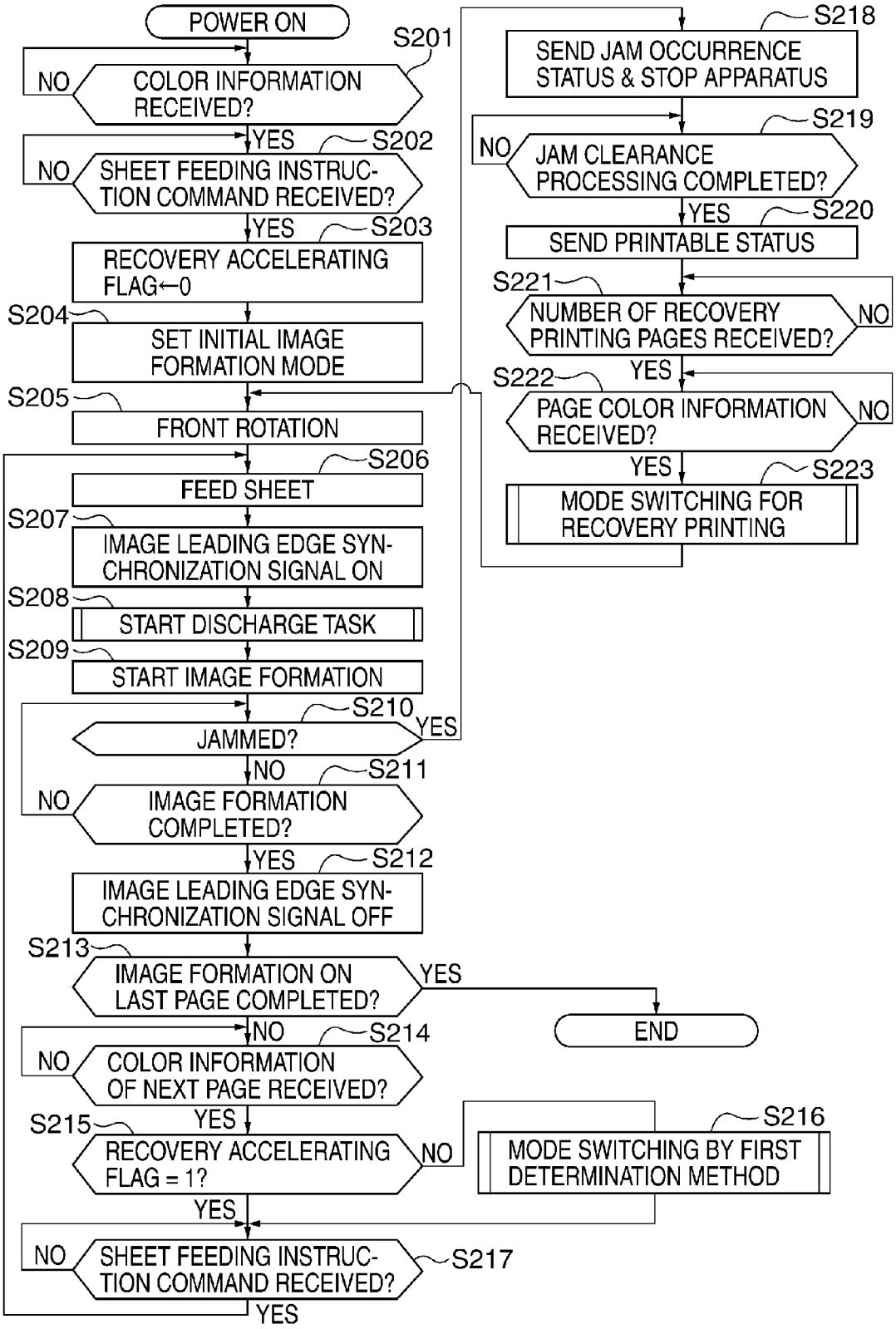
FIG. 13A is a flowchart of an engine control process executed by an engine controller.

FIG. 13A is a flowchart of an engine control process executed by the engine controller 21.

First, in a step S201, the CPU 211 waits for receipt of color information sent from the controller 22 (in the step S120 in FIG. 11B). Upon receipt of the color information, the CPU 211 waits for receipt of a sheet feeding instruction command sent from the controller (in the step S121 in FIG. 11B) in a step S202. Upon receipt of the sheet feeding instruction command, the CPU 211 clears the recovery accelerating flag in a step S203 (sets the recovery accelerating flag to 0). The recovery accelerating flag is set to 1 during recovery printing, more specifically, it is set to 1 in a step S408 in FIG. 15, referred to hereinafter.

Next, the CPU 211 sets an initial image formation mode in a step S204. In this step, the CPU 211 sets the image formation mode according to the color information of the first page in the print job, that is, if the color information indicates a color image, the CPU 211 sets the image formation mode to the all-contact mode, whereas if the color information indicates a monochrome image, the CPU 211 sets the image formation mode to the partial-contact mode.

Next, in a step S205, the CPU 211 performs various operations necessary for the image formation operation which is so-called front rotation. These operations are not directly related to the present invention, and hence detailed description thereof is omitted. When the front rotation is completed, the CPU 211 feeds a recording sheet P in a step S206. When the leading edge of the fed recording sheet P has reached the recording sheet leading edge detection sensor 9*e*, the CPU 211 switches on the image leading edge synchronization signal in a step S207. Next, the CPU 211 starts a sheet discharging task process shown in FIG. 13B in a step S208.

Figure 13B:
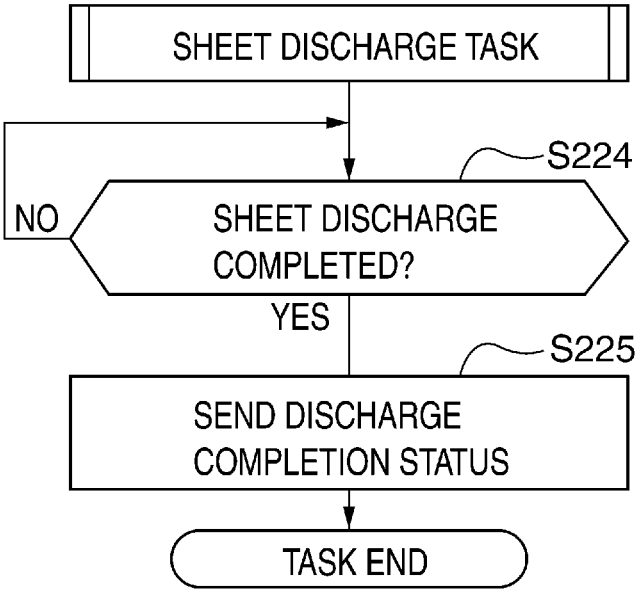
FIG. 13B is a flowchart of a sheet discharging task process started in a step in the engine control process executed by the engine controller.

FIG. 13B is a flowchart of the sheet discharging task process. The sheet discharging task process determines whether or not a recording sheet P has been discharged, and operates in parallel with the engine control process in FIG. 13A.

The CPU 211 waits for completion of sheet discharging in a step S224, and upon completion of the sheet discharge, the CPU 211 sends the discharge completion status to the controller 22 in a step S225, followed by terminating the present task.

Referring again to FIG. 13A, the CUP 211 starts image formation in a step S209. In this step, various kinds of high-voltage control for forming toner images on the respective photosensitive members 31, temperature control for the fixing section 5 which heats and fixes the toner images transferred onto the recording sheet P, and so forth, are started. These are not directly related to the present invention, and hence detailed description thereof is omitted.

In a step S210, the CPU 211 determines whether or not a sheet is jammed based on detection results from the jam detection sensors 9*a* to 9*j*. If a jam has not occurred, the CPU 211 waits for completion of the current image formation for one page in a step S211, thereby repeatedly executing the steps S210 and S211. Then, when image formation has been completed, the CPU 211 switches off the image leading edge synchronization signal in a step S212.

Next, in a step S213, the CPU 211 determines whether or not the immediately preceding page on which image formation has been performed is the last page of the print job. This is determined by determining whether or not the above-mentioned last page command sent from the controller 22 in the step S126 in FIG. 11B has been received. If image formation on the last page has been completed, the process in FIG. 13A is terminated. However, if image formation on the last page has not been finished, the CPU 211 waits for receipt of color information of a next page in a step S214.

Then, upon receipt of the color information of the next page, the CPU 211 determines whether or not the recovery accelerating flag is equal to 1 in a step S215. If the recovery accelerating flag is not equal to 1, this indicates that at least it is not during recovery printing. Therefore, the CPU 211 proceeds to a step S216, wherein the CPU 211 executes a mode switching process (see FIG. 14) by the first image formation mode-determining method.

On the other hand, if it is determined in the step S215 that the recovery accelerating flag is equal to 1, this means that the second determination method is selected during recovery printing, the process proceeds to a step S217 so as to maintain the selection.

Figure 14:
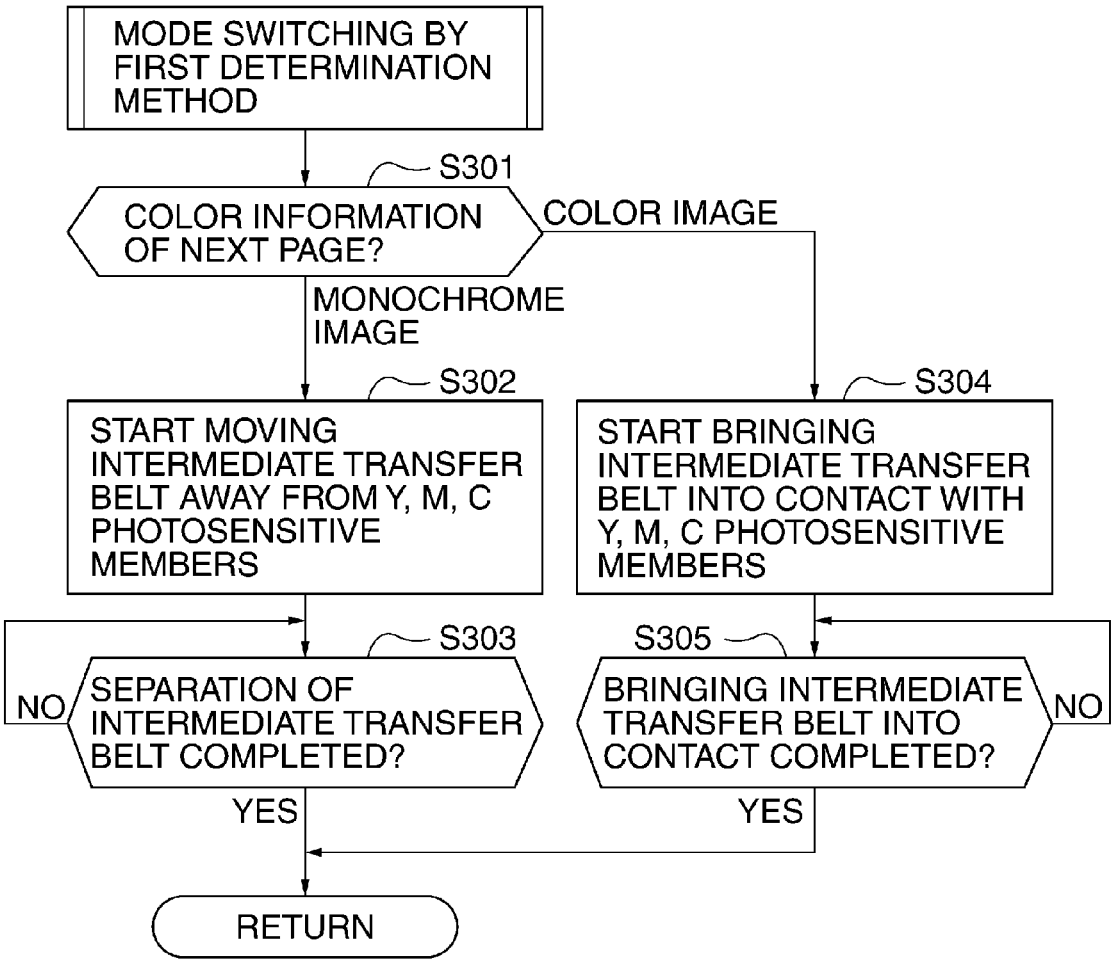
FIG. 14 is a flowchart of a mode switching process according to the first determination method, executed in a step in the process shown in FIG. 13A.

FIG. 14 is a flowchart of the mode switching process based on the first determination method, which is executed in the step S216 of the process in FIG. 13A. Before occurrence of a jam, the mode switching process based on the first determination method shown in FIG. 14 is necessarily executed.

First, in a step S301, the CPU 211 determines whether the color information of the next page indicates a color image or a monochrome image. Then, if the color information of the next page indicates a color image, the CPU 211 drivingly controls the intermediate transfer belt-moving motor M2 to bring the intermediate transfer belt 32 into contact with the photosensitive members (31Y, 31M, 31C) for color toner in steps S304 and S305. Thus, when the CPU 211 proceeds to the steps S304 and S305, the image formation mode is set to the all-contact mode.

On the other hand, if it is determined in the step S301 that the color information of the next page indicates a monochrome image, the CPU 211 executes steps S302 and S303. In the steps S302 and S303, the CPU 211 drivingly controls the intermediate transfer belt-moving motor M2 to move the intermediate transfer belt 32 away from the photosensitive members (31Y, 31M, 31C) for color toner. Thus, when the process proceeds to the steps S302 and S303, the image formation mode is set to the partial-contact mode.

After execution of the mode switching process shown in FIG. 14, the process proceeds to the step S217 in FIG. 13A. In the step S217, the CPU 211 waits for receipt of the sheet feeding instruction command, and upon receipt of the sheet feeding instruction command, the CPU 211 returns to the step S206, wherein the CPU 211 proceeds to the control starting from feeding of a next recording sheet P.

Next, a description will be given of processing executed in a case where a print job is interrupted due to occurrence of a jam.

If it is determined in the step S210 in FIG. 13A that the recording sheet P is jammed, the CPU 211 sends the jam occurrence status to the controller 22, and stops the apparatus by stopping the motors etc. in the step S218.

Next, in a step S219, the CPU 211 waits for completion of the jam clearance processing by the user. The CPU 211 detects the operation for opening/closing the doors 8*a* to 8*e* based on the signals output from the door open/close detection sensors 11*a* to 11*e* to thereby determine whether or not the jam clearance processing is completed.

Then, when the apparatus is enabled to form an image again after the jam clearance processing has been completed, in the step S220, the CPU 211 sends the printable status to the controller 22.

As described above, when the controller 22 receives the printable status, the controller 22 proceeds to recovery printing by the image transmission task process (see FIG. 11B) after the restart. Then, the controller 22 sends all of the number of pages and color information (see FIGS. 12C and 12D) of the remaining images, which have not been printed but have been continuously read even during the jam clearance processing. These are information items sent from the controller 22 to the engine controller 21 at the start of the recovery printing in the steps S119 and S120 in the image transmission task process (see FIG. 11B) after the restart.

The CPU 211 waits for receipt of the number of pages and color information of the remaining images, which have not been printed, in respective steps S221 and S222, and upon receipt of the two information items, the CPU 211 proceeds to a step S223. The number of read pages (ReadPage), shown in FIG. 12C by way of example, and the color information (information which associates PageNum with ColorInfo), shown in FIG. 12D by way of example, which have been received in these steps, are stored in the RAM 213. The number of read pages (ReadPage) is the latest one. Further, the value of the number of read pages is a value obtained after the jam, and hence the number of read pages (ReadPage) is equal to the number of pages to be printed in recovery printing (RecoverPage).

Figure 15:
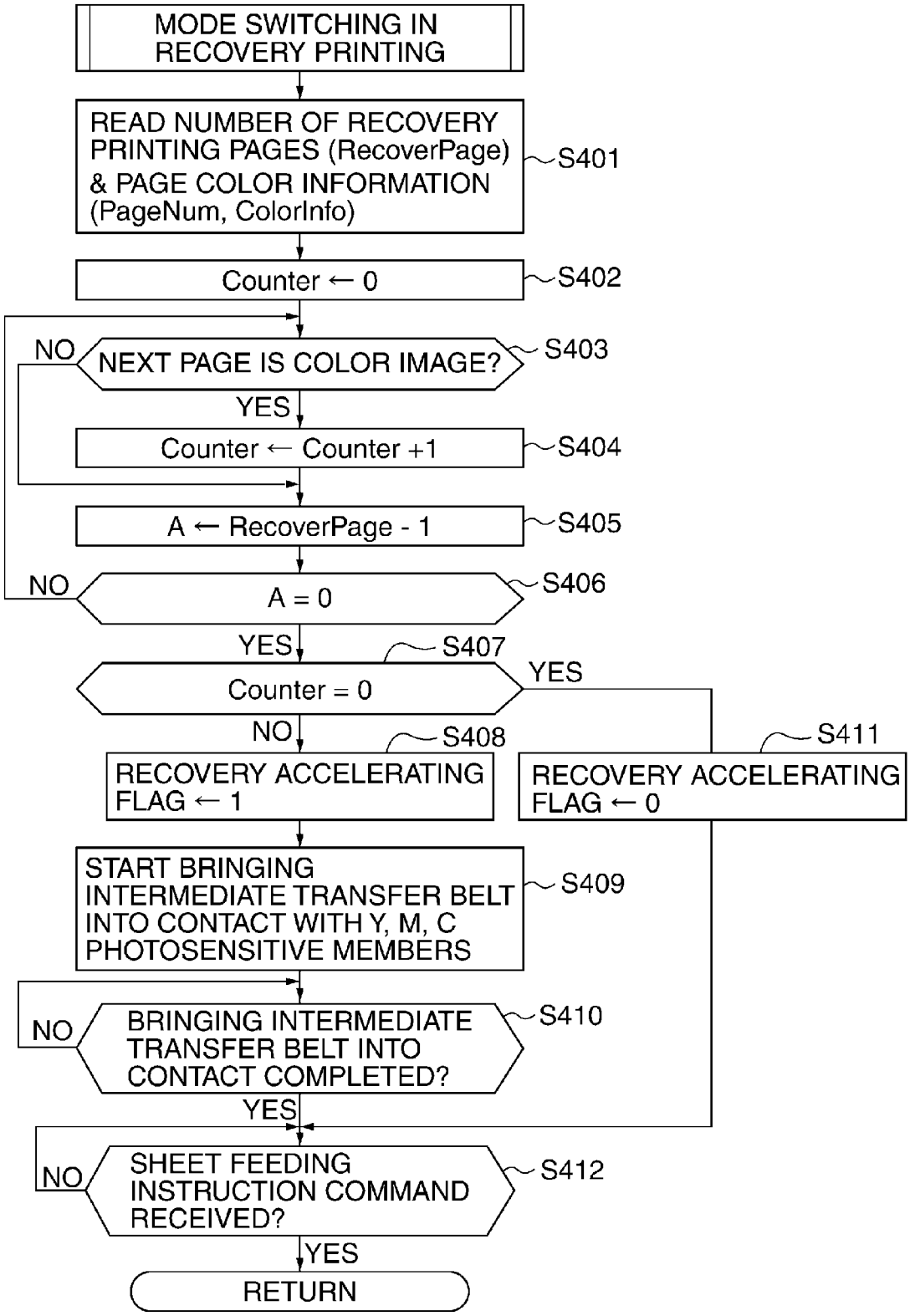
FIG. 15 is a flowchart of a mode switching process in recovery printing, executed in a step in the process shown in FIG. 13A.

In the step S223, a mode switching process during recovery printing, described hereinafter with reference to FIG. 15, is executed (operation of a selection unit).

Although some manners of mode switching during recovery printing can be considered, in the present embodiment, one of the manners is used, and other manners are used in a second embodiment et seq.

FIG. 15 is a flowchart of a mode switching process in recovery printing, executed in the step 223 of the process in FIG. 13A.

In a step S401, the CPU 211 reads out the number of pages (RecoverPage) to be printed in recovery printing and the color information (PageNum, ColorInfo) from the RAM 213 (operations of a second obtaining unit and a first obtaining unit). Next, in a step S402, the CPU 211 resets a value Counter to 0. The value Counter is a value of a counter that counts the number of color pages out of the pages to be printed in recovery printing.

Subsequent steps S403 to S406 are a process for checking whether or not at least one page of color image is included in the pages to be printed in recovery printing based on the color information, and also counting the number of pages of color images. That is, the CPU 211 sequentially refers to the color information from the pages of read information one by one, and determines whether or not a next page is a color image (step S403). Only when the next page is a color image, the CPU 211 counts up the value Counter by one (step S404). Then, the CPU 211 sets a value obtained by subtracting 1 from the number of pages to be printed in recovery printing (RecoverPage) to a variable A (step S405), and repeats the steps S403 to S406 until A=0 is obtained.

When A=0 holds, the CPU 211 determines in a step S407 whether or not the value Counter is equal to 0 (operation of a determination unit). If the value Counter is equal to 0, it is judged that the pages to be printed in recovery printing are all monochrome image pages and no page of color image is included, and hence the CPU 211 sets the recovery accelerating flag to 0 in a step S411. This indicates that the first determination method is selected as the image formation mode-determining method for recovery printing. Then, the CPU 211 proceeds to a step S412.

On the other hand, if it is determined in the step S407 that the value Counter is not equal to 0, this indicates that at least one page of color image is included in the pages to be printed in recovery printing. Then, the CPU 211 sets the recovery accelerating flag to 1 in the step S408. This indicates that the second determination method is selected as the image formation mode-determining method for recovery printing. Since the image formation mode is determined by the second determination method, the all-contact mode is set as the image formation mode.

Therefore, in this case, since the image formation mode is set to the all-contact mode, the CPU 211 drivingly controls the intermediate transfer belt-moving motor M2 to bring the intermediate transfer belt 32 into contact with the photosensitive members (31Y, 31M, 31C) for color toner in steps S409 and S410. Then, the CPU 211 proceeds to the step S412.

In the step S412, the CPU 211 waits for receipt of the sheet feeding instruction command, and upon receipt of the sheet feeding instruction command, the CPU 211 returns to the step S205 in FIG. 13A.

In the mode switching process shown in FIG. 15, the CPU 211 selects the second determination method if at least one page of color image is included in the pages on which image formation is to be performed in recovery printing, whereas if not, the CPU 211 selects the first determination method. When the second determination method is selected, the image formation mode is set to the all-contact mode irrespective of whether a page on which an image is to be formed is a color page or a monochrome page, and the image formation mode is not switched during recovery printing. This eliminates time required to switch the image formation mode, whereby the recovery printing time period is reduced (see the lower line in FIG. 9). On the other hand, when no page of color image is included in the pages to be printed in recovery printing, the first determination method continues to be selected even in the recovery printing, similarly to printing before job interruption.

According to the present embodiment, the first determination method is selected before a print job is interrupted, and for recovery printing, the second determination method or the first determination method is selected depending on whether or not at least one page of color image is included in the pages to be printed in recovery printing. Further, in the second determination method, the all-contact mode is set as the image formation mode for all pages on which image formation is to be performed.

Therefore, the image formation mode is set to the all-contact mode in a case where an advantageous effect of reduction of the recovery printing time period can be expected, whereas if not, the image formation mode is set to the partial-contact mode to thereby avoid unnecessary abrasion of the photosensitive members (31Y, 31M, 31C) for color toner. Therefore, it is possible to recover a time period lost due to interruption caused by a jam, while achieving both of reduction of the printing time and prevention of abrasion and deterioration of the photosensitive members (31Y, 31M, 31C) for color toner. As a consequence, it is possible to properly reduce the recovery printing time period, while reducing abrasion and deterioration of the image bearing members (photosensitive members).

Note that in the present embodiment, in FIG. 15, it is not necessarily required to count the number of pages of color images in the pages to be printed in recovery printing, but the image forming apparatus may be configured such that it is only determined whether or not at least one page of color image is included.

Next, a description will be given of the second embodiment of the present invention. The second embodiment differs from the first embodiment in the mode switching process in recovery printing, but is the same in the other hardware configuration and software configuration. Therefore, in the present embodiment, differently from the first embodiment, the mode switching process in recovery printing will be described with reference to FIG. 17 in place of FIG. 15, and further with reference to FIGS. 16A to 16C in place of FIG. 9.

Figures 16A, 16B, 16C:
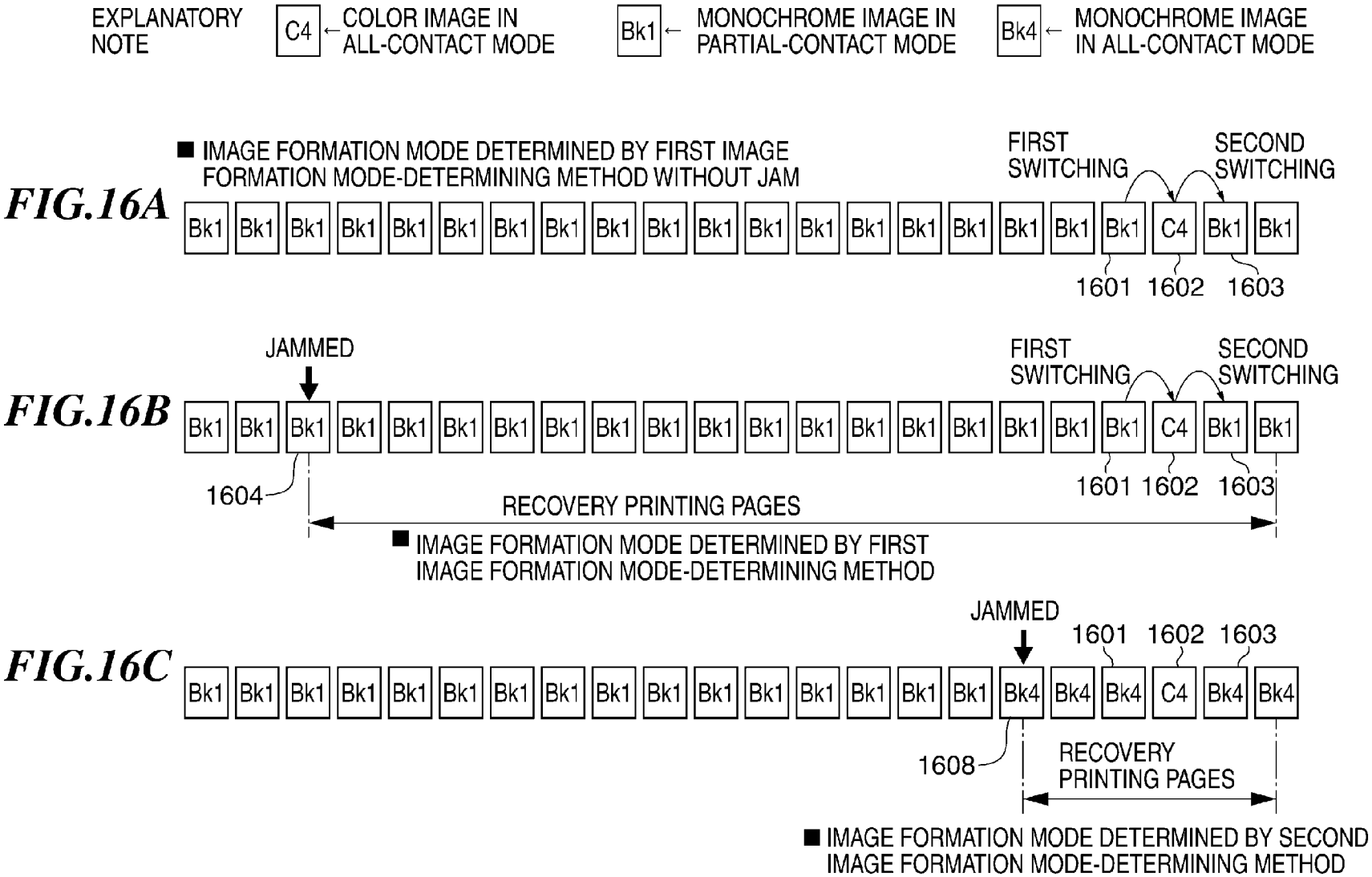
FIGS. 16A to 16C are conceptual diagrams each showing progression over time of processing of a print job, which is executed by an image forming apparatus according to a second embodiment of the present invention, in which a color image and monochrome images are mixed, in which FIG. 16 A shows a case where the processing is normally executed without occurrence of a jam.

FIG. 16A is a conceptual diagram showing progression over time of processing of a print job in which a color image and monochrome images are mixed.

The illustrated example in FIG. 16A shows progression over time of processing of a print job in a case where a color page (C4) is included in the vicinity of the end of the job, and printing is completed without being interrupted by a jam. The image formation mode-determining method is set to the first image formation mode-determining method from the start to the end of printing. The image formation mode is switched a total of only two times, i.e. between Bk1 (1601) and C4 (1602), and between C4 (1602) and Bk1 (1603).

FIG. 16B shows progression over time of processing of the print job shown in FIG. 16A, in a case where a jam occurs in an early stage (1604) of the job, and recovery printing is executed. The image formation mode-determining method is set to the first image formation mode-determining method from the start to the end of printing. In the illustrated example in FIG. 16B, the image formation mode is switched a total of only two times similarly to FIG. 16A.

In the illustrated example in FIG. 16B, compared with the large number of pages to be printed in recovery printing, the number of times of mode switching is small, and hence even if the image formation mode-determining method is set to the second determination method, the number of times of mode switching can be reduced only twice, which is not so effective in reduction of the mode switching time period. Rather, since the image formation mode-determining method is set to the second determination method, a lot of monochrome pages are to be subjected to image formation in the all-contact mode, this results in a disadvantage that abrasion and deterioration of the three photosensitive members (31Y, 31M, 31C) for color toner are accelerated.

For the above reason, it is judged that when the number of pages to be printed in recovery printing is large, it is preferable to continue to use the first determination method as the image formation mode-determining method in recovery printing by placing importance on reduction of abrasion of the photosensitive members (31Y, 31M, 31C) for color toner.

FIG. 16C shows progression over time of processing of the print job shown in FIG. 16A, in a case where a jam occurs in a stage near the end of the job (1608), and recovery printing is executed. In the illustrated example in FIG. 16C, differently from FIG. 16B, since the number of pages to be printed in recovery printing is small, even if the image formation mode-determining method in recovery printing is switched to the second determination method, abrasion of the photosensitive members (31Y, 31M, 31C) for color toner is not so accelerated. On the other hand, by changing the image formation mode-determining method to the second determination method, it is possible to obtain a merit in reducing the number of times of mode switching. Then, in the illustrated example in FIG. 16C, it is judged that it is preferable to select the second determination method as the image formation mode-determining method in recovery printing.

Figure 17:
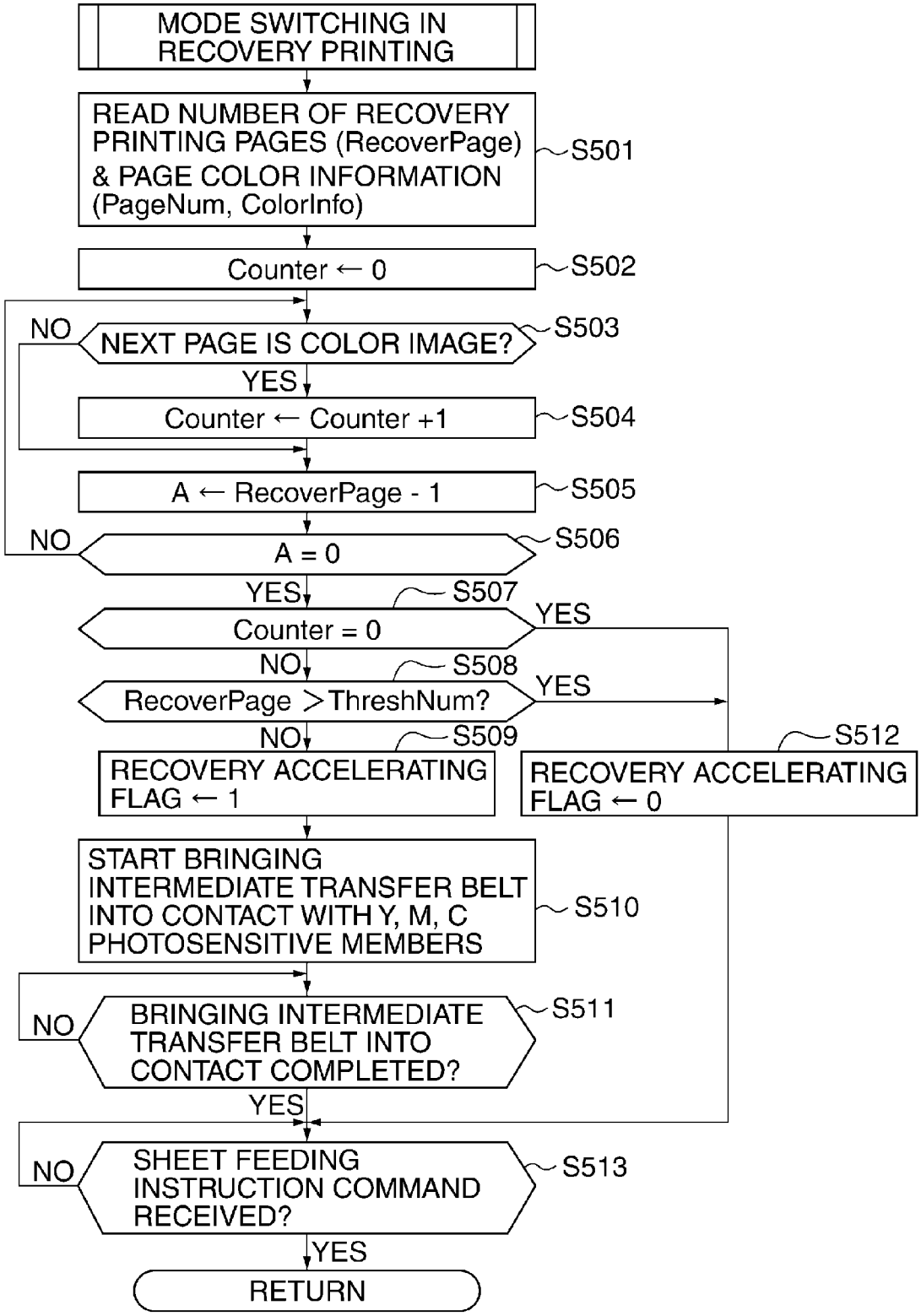
FIG. 17 is a flowchart of a mode switching process in recovery printing, which is executed by the image forming apparatus according to the second embodiment in a step in the process shown in FIG. 13A.

FIG. 17 is a flowchart of the mode switching process in recovery printing, which is executed in the step S223 of the process in FIG. 13A, according to the second embodiment.

In FIG. 17, steps S501 to S507 are the same as the steps S401 to S407 in FIG. 15. If it is determined in the step S507 that the value Counter is equal to 0, this indicates that no page of color image is included in the pages to be printed in recovery printing, and hence in a step S512, the CPU 211 executes the same processing as in the step S411 in FIG. 15. As a result, the first determination method is selected as the image formation mode-determining method for recovery printing. Then, the CPU 211 proceeds to a step S513.

On the other hand, if it is determined in the step S507 that the value Counter is not equal to 0, this indicates that at least one page of color image is included in the pages to be printed in recovery printing. Then, the CPU 211 determines whether or not the number of pages to be printed in recovery printing (RecoverPage) is larger than a predetermined number (ThreshNum) in a step S508.

If it is determined in the step S508 that the number of pages to be printed in recovery printing (RecoverPage) is not larger than the predetermined number (ThreshNum), it is judged that a larger advantageous effect is obtained from reduction of the mode switching time period than from reduction of abrasion of the photosensitive members 31. Then, the CPU 211 executes the same processing in steps S509 to S511 as that in the steps S408 to S410 in FIG. 15. That is, the recovery accelerating flag is set to 1, and the second determination method is selected as the image formation mode-determining method for recovery printing to thereby set the image formation mode to the all-contact mode. Then, the CPU 211 proceeds to the step S513.

On the other hand, if it is determined in the step S508 that the number of pages to be printed in recovery printing (RecoverPage) is larger than the predetermined number (ThreshNum), it is judged that the advantageous effect obtained from reduction of the mode switching time period is small, and hence the priority should be placed on reduction of abrasion of the photosensitive members 31. Then, in the step S512, the CPU 211 executes the same processing as in the step S411 in FIG. 15, to thereby select the first determination method as the image formation mode-determining method for recovery printing.

Thereafter, the CPU 211 proceeds to the step S513. In the step S513, the CPU 211 executes the same processing as in the step S412 in FIG. 15.

According to the present embodiment, in recovery printing, if at least one page of color image is included in pages on which image formation is to be performed, and also, the number of pages to be printed in recovery printing is not larger than the predetermined number, the second determination method is selected. However, in other cases, the first determination method is selected. That is, even if at least one color image is included, when the number of pages to be printed in recovery printing is larger than the predetermined number, the first determination method is selected.

This makes it possible to properly reduce the recovery printing time while reducing abrasion and deterioration of the image bearing members (photosensitive members), by properly taking into account a balance between reduction of the mode switching time period and reduction of abrasion of the photosensitive members 31.

Next, a description will be given of a third embodiment of the present invention. The third embodiment differs from the first embodiment in the mode switching process in recovery printing, but is the same in the other hardware configuration and software configuration. Therefore, in the present embodiment, differently from the first embodiment, the mode switching process in recovery printing will be described with reference to FIG. 19 in place of FIG. 15, and further with reference to FIGS. 18A and 18B in place of FIG. 9.

Figure 18A:
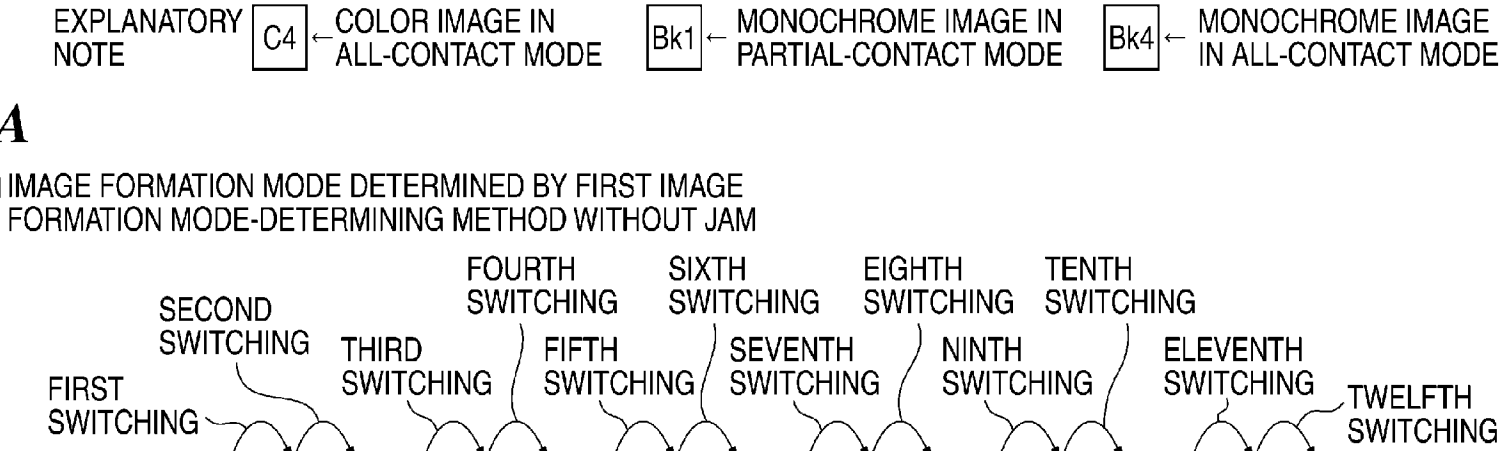

FIG. 18A is a conceptual diagram showing progression over time of processing of a print job in which color images and monochrome images are mixed, which is executed by an image forming apparatus according to the third embodiment.

The illustrated example in FIG. 18A shows progression over time of processing of a print job in a case where a lot of color pages are included, and printing is completed without being interrupted by a jam. The first determination method is selected as the image formation mode-determining method from the start to the end of printing. Switching of the image formation mode for a change from C4 to Bk1 or from for a change from Bk1 to C4 occurs a total of 12 times.

Figure 18B:
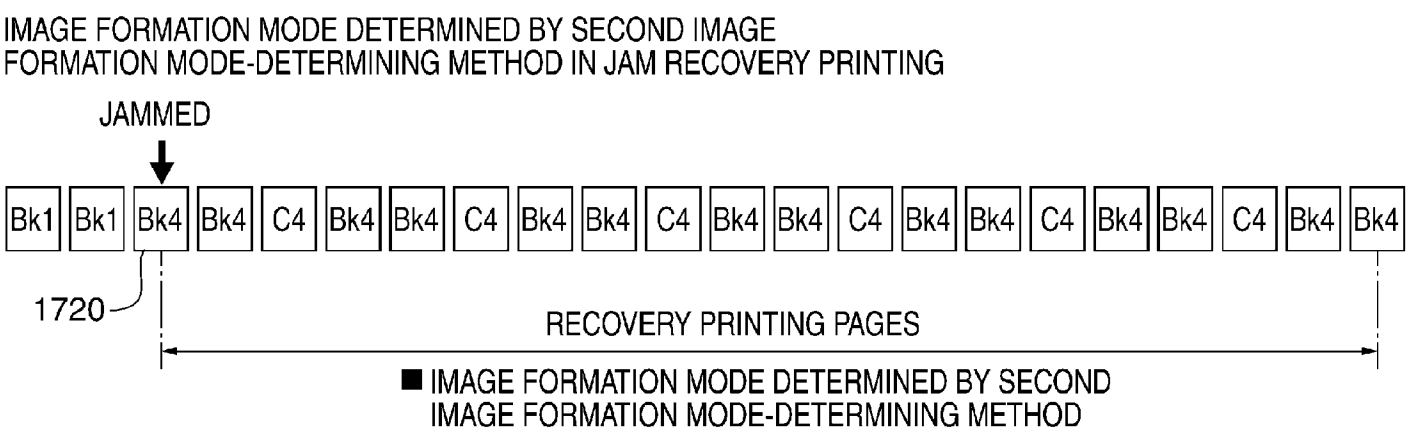

FIG. 18B shows progression over time of processing of a print job in a case where a jam occurs in an early stage (1720) of the print job, and recovery printing is executed. In the illustrated example in FIG. 18B, since a jam occurs at an early stage of the print job, the number of pages to be printed in recovery printing is large. Further, if the first determination method is selected, the image formation mode is switched 12 times.

Particularly, compared with the illustrated example in FIG. 16A, a ratio of the number of times of mode switching to the number of pages to be printed in recovery printing is larger.

Therefore, a large advantageous effect is obtained by reducing the number of times of mode switching by changing the image formation mode-determining method for recovery printing. When the second determination method is selected by comparing the effect of reducing the number of times of mode switching and the effect of reduction of abrasion and deterioration of the photosensitive members (31Y, 31M, 31C) for color toner for consideration, a larger advantageous effect is obtained by reducing the number of times of mode switching to thereby reduce the recovery printing time period. Then, in the illustrated example in FIG. 18B, it is judged that it is preferable to select the second determination method as the image formation mode-determining method for recovery printing.

As shown in the above-described example in FIG. 16C, when at least one color page is included in the pages to be printed in recovery printing, and also the number of pages to be printed in recovery printing is small, a large advantageous effect is obtained by changing the image formation mode-determining method to the second determination method. However, as shown in FIG. 18B, even when the number of pages to be printed in recovery printing is large, if the number of included color pages is large, again, it is more likely that the advantageous effect provided by changing the determination method to the second determination method is larger.

Figure 19:
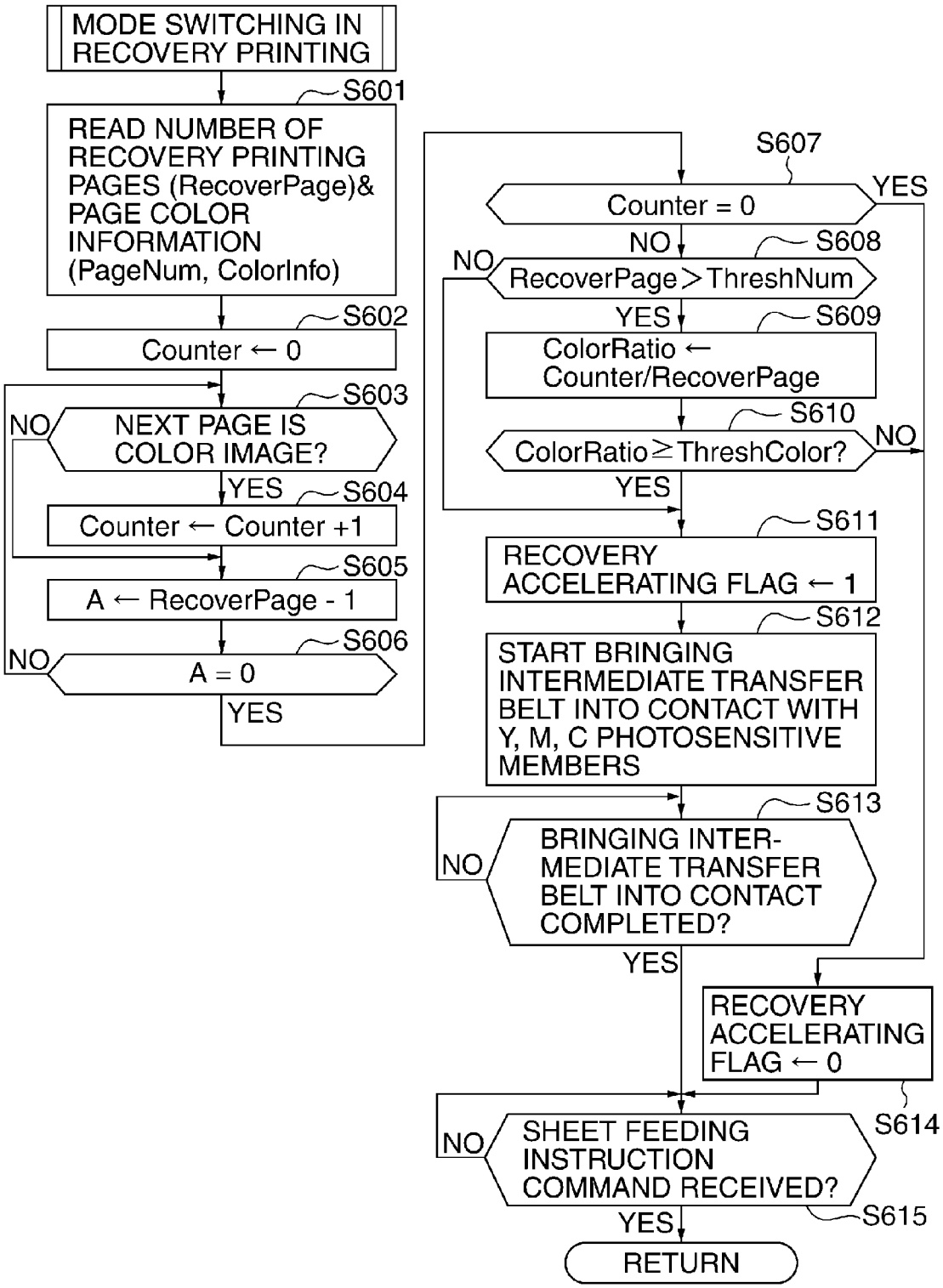
FIG. 19 is a flowchart of a mode switching process in recovery printing, which is executed in a step in the process shown in FIG. 13A by the image forming apparatus according to the third embodiment.

FIG. 19 is a flowchart of the mode switching process in recovery printing, which is executed in the step S223 of the process in FIG. 13A, according to the third embodiment.

In FIG. 19, steps S601 to S607 are the same as the steps S401 to S407 in FIG. 15. If it is determined in the step S607 that the value Counter is equal to 0, this indicates that no page of color image is included in the pages to be printed in recovery printing, and hence in a step S614, the CPU 211 executes the same processing as that in the step S411 in FIG. 15. By execution of this step, the first determination method is selected as the image formation mode-determining method for recovery printing. Then, the CPU 211 proceeds to a step S615.

On the other hand, if it is determined in the step S607 that the value Counter is not equal to 0, this indicates that at least one page of color image is included in the pages to be printed in recovery printing. Then, the CPU 211 determines in a step S608 whether or not the number of pages to be printed in recovery printing (RecoverPage) is larger than the predetermined number (ThreshNum).

If it is determined in the step S608 that the number of pages to be printed in recovery printing (RecoverPage) is not larger than the predetermined number (ThreshNum), it is judged that a larger advantageous effect is obtained from reduction of the mode switching time period than from reduction of abrasion of the photosensitive members 31. Then, in steps S611 to S613, the CPU 211 executes the same processing as that in the steps S408 to S410 in FIG. 15. That is, the recovery accelerating flag is set to 1 and the second determination method is selected as the image formation mode-determining method for recovery printing to thereby set the image formation mode to the all-contact mode. Then, the CPU 211 proceeds to the step S615.

On the other hand, if it is determined in the step S608 that the number of pages to be printed in recovery printing (RecoverPage) is larger than the predetermined number (ThreshNum), the CPU 211 proceeds to a step S609. In the step S609 (operation of a calculation unit), the CPU 211 calculates a ratio of the number of color pages to the number of pages to be printed in recovery printing by Counter/RevoverPage. Then, the CPU 211 substitutes the calculated ratio into a register ColorRatio as a color ratio.

Next, in a step S610, the CPU 211 determines whether or not the value of ColorRatio is not lower than a predetermined ratio ThreshRatio. If it is determined in the step S610 that the value of ColorRatio is not lower than the predetermined ratio ThreshRatio, a larger advantageous effect is obtained by reducing the mode switching time period through reduction of the number of times of mode switching. Then, the CPU 211 executes the steps S611 to S613. That is, the recovery accelerating flag is set to 1 and the second determination method is selected as the image formation mode-determining method for recovery printing to set the image formation mode to the all-contact mode.

On the other hand, if the value of ColorRatio is lower than the predetermined ratio ThreshRatio, it is judged that the advantageous effect obtained by reducing the number of times of mode switching is small, and hence the priority should be placed on reduction of abrasion of the photosensitive members 31. Then, the CPU 211 executes the step S614. That is, the first determination method is selected as the image formation mode-determining method for recovery printing.

After execution of the step S614, the CPU 211 proceeds to the step S615. In the step S615, the CPU 211 executes the same processing as that in the step S412 in FIG. 15.

According to the present embodiment, when at least one page of color image is included in the pages on which image formation is to be performed in recovery printing, and also the number of pages to be printed in recovery printing is not larger than the predetermined number, the second determination method is selected. Further, also when at least one page color image is included in the pages on which image formation is to be performed, also the number of pages to be printed in recovery printing is larger than the predetermined number, and also the color ratio is not lower than the predetermined ratio, the second determination method is selected. However, in the other cases, the first determination method is selected. Therefore, even when the number of pages to be printed in recovery printing is larger than the predetermined number, if the color ratio is lower than the predetermined ratio, the first determination method is selected.

This makes it possible to properly reduce the recovery printing time period while reducing abrasion and deterioration of the image bearing members (photosensitive members), by properly taking into account a balance between reduction of the mode switching time period and reduction of abrasion of the photosensitive members 31.

Next, a description will be given of a fourth embodiment of the present invention. The third embodiment is focused on the color ratio. However, the number of times of switching of the image formation mode depends not only on the number of color pages which are mixed, but also on how the color pages are mixed (mixed pattern), and a pattern having a larger number of times of mode switching becomes longer in total time period required for mode switching. Therefore, as the ratio of a total time period required for mode switching during recovery printing to a total time period from the start to the end of recovery printing is higher, a larger advantageous effect is obtained by selecting the second determination method. In the present embodiment, by taking this into account, the image formation mode-determining method is selected.

The fourth embodiment differs from the first embodiment in the mode switching process in recovery printing, but is the same in the other hardware configuration and software configuration. Therefore, in the present embodiment, differently from the first embodiment, description of the mode switching process in the recovery printing will be given with reference to FIG. 20 in place of FIG. 15.

Figure 20:
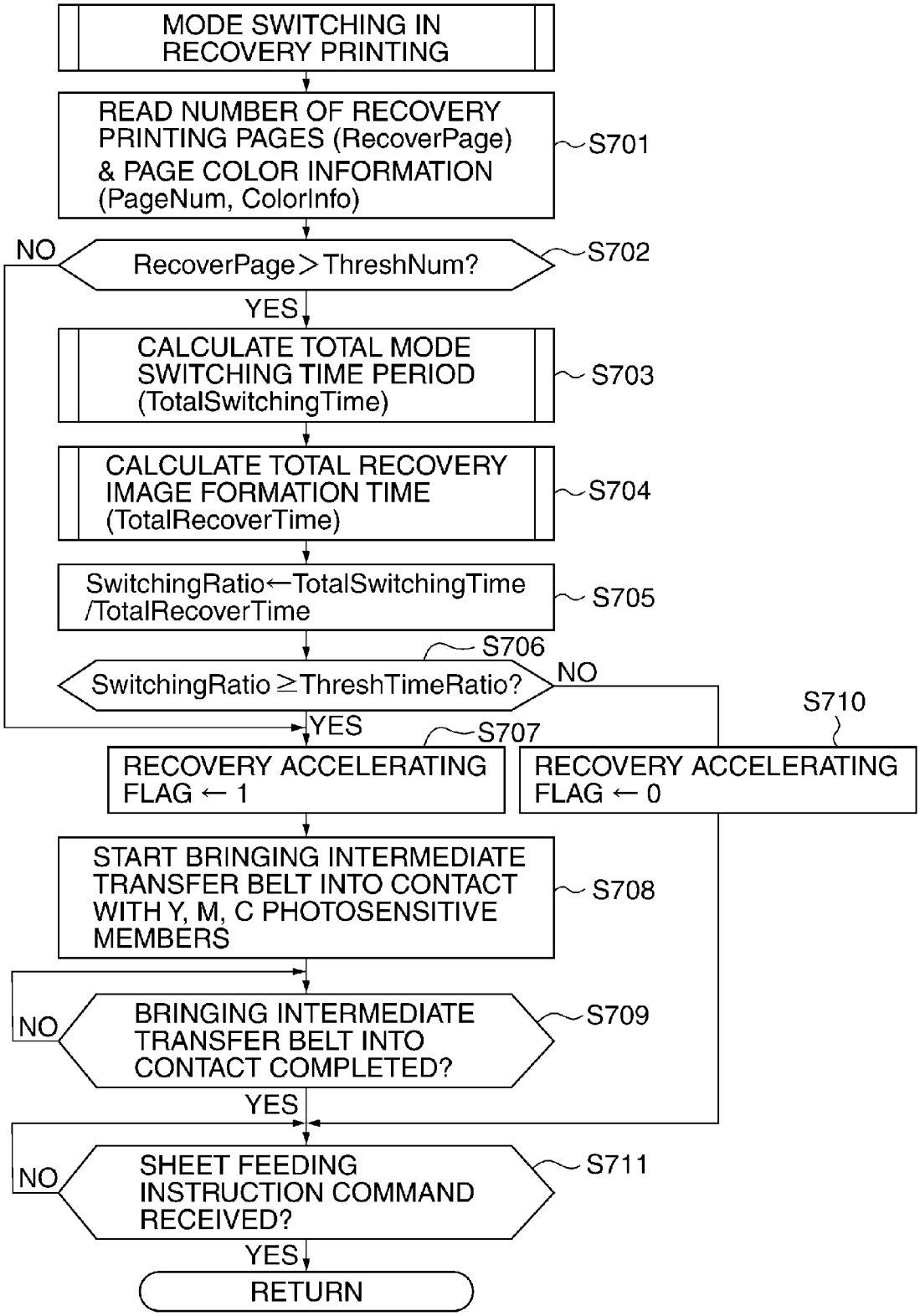
FIG. 20 is a flowchart of a mode switching process in recovery printing, which is executed in a step in the process shown in FIG. 13A by an image forming apparatus according to a fourth embodiment of the present invention.

FIG. 20 is a flowchart of the mode switching process in recovery printing, which is executed in the step S223 of the process in FIG. 13A, by an image forming apparatus according to the fourth embodiment.

A step S701 is the same as the step S401 in FIG. 15. In a step S702, the CPU 211 determines whether or not the number of pages to be printed in recovery printing (RecoverPage) is larger than the predetermined number (ThreshNum).

If it is determined in the step S702 that the number of pages to be printed in recovery printing (RecoverPage) is not larger than the predetermined number (ThreshNum), it is judged that the advantageous effect obtained from reduction of the mode switching time period is larger than that obtained from reduction of abrasion of the photosensitive members 31. Then, in steps S707 to S709, the CPU 211 executes the same processing as that in the steps S408 to S410 in FIG. 15. That is, the recovery accelerating flag is set to 1, and the second determination method is selected as the image formation mode-determining method in recovery printing to set the image formation mode to the all-contact mode. Then, the CPU 211 proceeds to a step S711.

On the other hand, if it is determined in the step S702 that the number of pages to be printed in recovery printing (RecoverPage) is larger than the predetermined number (ThreshNum), the CPU 211 proceeds to a step S703. In the step S703, the CPU 211 executes a total mode switching time period calculation process for calculating a total mode switching time period (TotalSwitchingTime) in FIG. 21, described hereinafter. Further, in a step S704, the CPU 211 executes a total recovery image formation time period calculation process for calculating a total recovery image formation time period (TotalRecoverTime) in FIG. 22A, described hereinafter.

Figure 21:
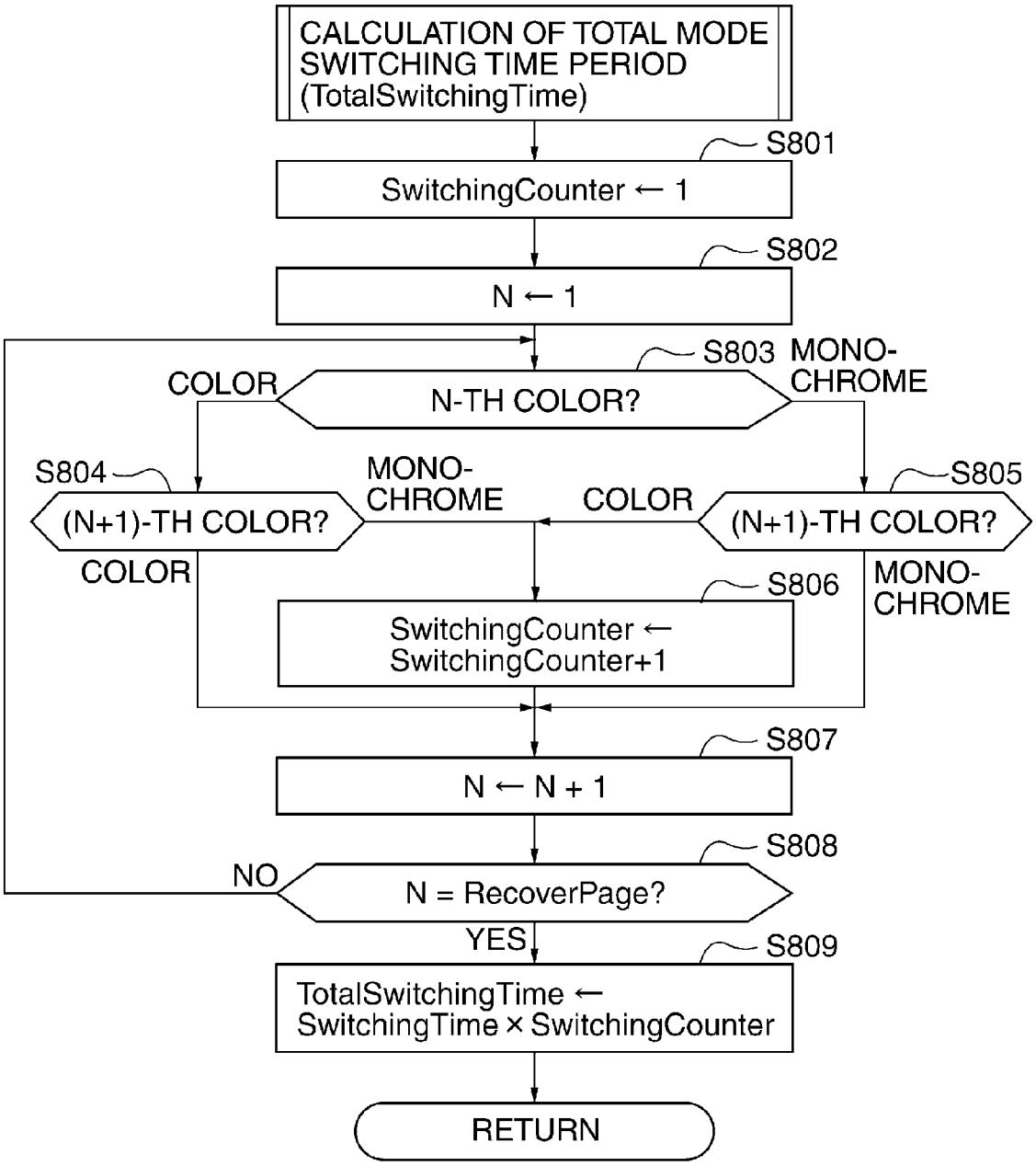
FIG. 21 is a flowchart of a total mode switching time period calculation process, which is executed in recovery printing in a step in the mode switching process shown in FIG. 20.

FIG. 21 is a flowchart of the total mode switching time period calculation process for calculating a total mode switching time period (TotalSwitchingTime), which is executed in the step S703 of the mode switching process in recovery printing in FIG. 20.

In the total mode switching time period calculation process, the total image formation mode switching time period is calculated which is a total of mode switching time periods estimated to be required to perform switching of the image formation mode for all pages, assuming that image formation is performed for all the pages by the first determination method in recovery printing.

First, in a step S801, the CPU 211 substitutes 0 into the counter value SwitchingCounter indicative of the number of times of switching of the image formation mode. Next, in a step S802, the CPU 211 substitutes 1 into a page number index N indicating which page, starting from the first page, of the pages to be printed in recovery printing, the present page is.

Next, in a step S803, the CPU 211 determines the color of an N-th page based on the color information. If it is determined in the step S803 that the N-th page is a color page, the CPU 211 checks the color of an (N+1)-th page in a step S804. If it is determined in the step S804 that the (N+1)-th page is a color page similarly to the N-th page, the CPU 211 proceeds to a step S807. In this case, the counter value SwitchingCounter is not changed.

On the other hand, if it is determined in the step S804 that the (N+1)-th page is a monochrome page, which means that switching of the image formation mode is to be executed, and hence the CPU 211 proceeds to a step S806, and increments the counter value SwitchingCounter by one.

If it is determined in the step S803 that the N-th page is a monochrome page, the CPU 211 checks the color of the (N+1)-th page in a step S805. If it is determined in the step S805 that the (N+1)-th page is a monochrome page similarly to the N-th page, the CPU 211 proceeds to the step S807. In this case, the counter value SwitchingCounter is not changed.

On the other hand, if it is determined in the step S805 that the (N+1)-th page is a color page, which means that switching of the image formation mode is to be executed, and hence the CPU 211 proceeds to the step S806, and increments the counter value SwitchingCounter by one.

In short, in a case where images sequentially adjacent to each other are the same in color, it means that the image formation mode is not to be switched, and hence the counter value SwitchingCounter is maintained. In a case where the sequentially adjacent images are different in color, it means that the image formation mode is to be switched, and hence the counter value SwitchingCounter is incremented.

After execution of the step S806, the CPU 211 increments the page number index N to N+1 in the step S807, and in a step S808, the CPU 211 determines whether or not the page number index N becomes equal to the number (RecoverPage) of pages to be printed in recovery printing. The CPU 211 repeats the steps S803 to S808 until the page number index N becomes equal to RecoverPage. When the page number index N becomes equal to RecoverPage, the counter value SwitchingCounter at the time is the number of times of mode switching (switching of the image formation mode) required to be executed in recovery printing. Thus, the number of times of mode switching is calculated by checking the pages to be printed in recovery printing from the first page to the last page thereof. Then, the CPU 211 proceeds to a step S809.

In the step S809, the CPU 211 multiplies the counter value SwitchingCounter by time SwitchingTime which is a time period required to switch the image formation mode once, and sets the calculation result in the total switching time (TotalSwitchingTime).

Figure 22A:
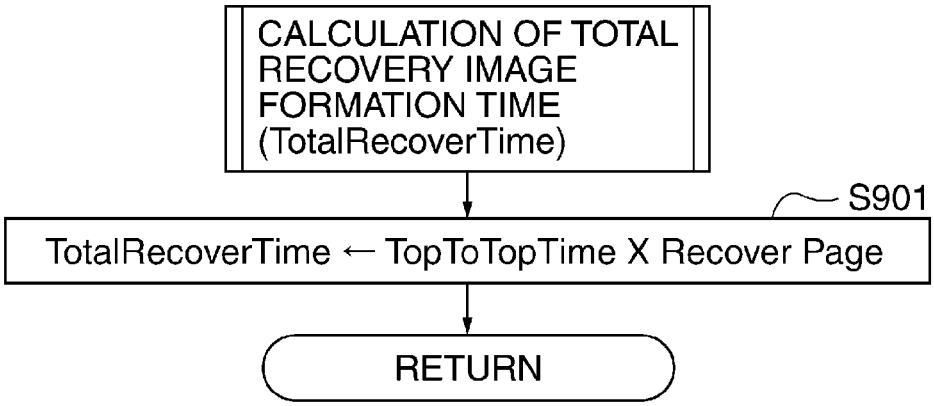
FIG. 22A is a flowchart of a total recovery image formation time period calculation process, which is executed in a step in the mode switching process in recovery printing shown in FIG. 20.

FIG. 22A is a flowchart of the total recovery image formation time period process for calculating the total recovery image formation time period (TotalRecoverTime), which is executed in the step S704 of the mode switching process in FIG. 20. The total recovery image formation time period calculation process is a process for estimating the total recovery image formation time period which is a time period estimated to be required to perform image formation for all pages assuming that image formation is performed in recovery printing for all the pages by the first determination method.

In a step S901, the CPU 211 multiplies time TopToTopTime indicative of a difference (time interval) in passage time between leading edges of two recording sheets P conveyed in succession by the number of pages to be printed in recovery printing (RecoverPage), and substitutes the calculation result into TotalRecoverTime. The passage time interval TopToTopTime will be described with reference to FIG. 22B.

Figure 22B:
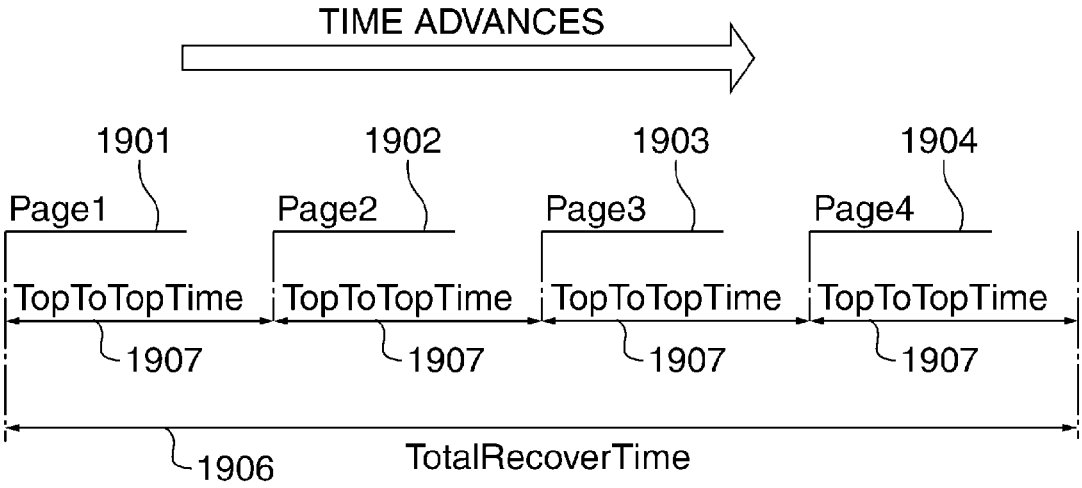
FIG. 22B is a diagram showing a relationship between a difference (time interval) in passage time between recording sheet leading edges and a total recovery image formation time period in recovery printing.

FIG. 22B is a diagram showing a relationship between TopToTopTime and TotalRecoverTime in recovery printing.

The time interval in conveyance between Page1 (1901) and Page2 (1902) is indicated by TopToTopTime (1907). The time interval in conveyance between Page2 (1902) and Page3 (1903) is also indicated by TopToTopTime (1907), and it is assumed that this is also the case with the subsequent Page3 (1903) and Page4 (1904). Therefore, the total time period required to convey Page1 to Page4 is obtained by multiplying TopToTopTime by 4 which is the number of pages, and this is the total recovery image formation time period 1906 (TotalRecoverTime).

Referring again to FIG. 20, in a step S705, the CPU 211 calculates a switching time ratio SwitchingRatio which is a ratio of the total mode switching time period (TotalSwitchingTime) to the total recovery image formation time period (TotalRecoverTime). That is, the CPU 211 substitutes the value obtained by TotalSwitchingTime/TotalRecoverTime into SwitchingRatio. Thus, the CPU 211 calculates the switching time ratio SwitchingRatio which is an estimated value (operation of an estimation unit).

Next, in a step S706, the CPU 211 determines whether or not the switching time ratio SwitchingRatio is not lower than a predetermined ratio (ThreshTimeRatio). If it is determined in the step S706 that the switching time ratio SwitchingRatio is not lower than the predetermined ThreshTimeRatio, it is judged that the ratio of the total time period required to switch the image formation mode to the total time period from the start to the end of the recovery printing is high. Then, the CPU 211 executes, in the steps S707 to S709, the same processing as that in the steps S408 to S410 in FIG. 15. That is, the recovery accelerating flag is set to 1, and the second determination method is selected as the image formation mode-determining method for recovery printing to set the image formation mode to the all-contact mode. Then, the CPU 211 proceeds to the step S711.

On the other hand, if it is determined in the step S706 that the switching time ratio SwitchingRatio is smaller than the predetermined ratio ThreshTimeRatio, it can be judged that the ratio of the total time period required to switch the image formation mode to the total time period from the start to the end of the recovery printing is low. Then, the CPU 211 executes, in a step S710, the same processing as that in the step S411 in FIG. 15. As a result, the first determination method is selected as the image formation mode-determining method for recovery printing. Then, the CPU 211 proceeds to the step S711. In the step S711, the CPU 211 executes the same processing as that in the step S412 in FIG. 15.

As described above, the image formation mode-determining method is selected by taking into account the actual performance of the apparatus (a time period required to switch the image formation mode once, and a speed of conveying a recording sheet), and hence it is possible to make a proper selection by estimating accurate effects.

According to the present embodiment, it is possible to obtain advantageous effects as provided by the second and third embodiments with respect to reduction of the recovery printing time, while reducing abrasion and deterioration of the image bearing members (photosensitive members).

Note that in the fourth embodiment, the total recovery image formation time period may be calculated as either of a time period without mode switching and a time period into which mode switching is taken into account.

By the way, although in the above-described embodiments, a jam is described as the cause of interruption of a print job by way example, the present invention can be applied to any other cause of interruption (e.g. toner-out or paper-out condition).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-188618, filed Aug. 29, 2012, which is hereby incorporated by reference herein in its entirety.

What is claimed is:

1. An image forming apparatus that performs a sequence of image formation processing operations according to a print job, for forming a toner image on at least one of a plurality of image bearing members, transferring the toner image formed on at least one of the plurality of image bearing members onto a belt member, and further transferring the toner image, which has been transferred onto the belt member, onto a recording sheet, comprising:

a shift unit configured to shift the belt member to thereby switch a position of the belt member relative to the plurality of image bearing members to an all-contact position in which the belt member is in contact with all of the plurality of image bearing members or a partial-contact position in which the belt member is in contact with only part of the plurality of image bearing members;

a first obtaining unit configured to obtain color information indicative of whether an image to be formed is a color image or a monochrome image, concerning each page on which image formation is to be performed according to the print job;

a recovery unit configured to perform recovery printing in a case where the print job is interrupted due to a cause of interruption;

a determination unit configured to determine, based on the color information obtained by said first obtaining unit, whether or not a color image is included in respective images for pages on which image formation is to be performed in recovery printing; and a selection unit configured to select, as a method of determining in which of the all-contact position and the partial-contact position, said shift unit is to position the belt member, a first determination method before a print job is interrupted, and select, based on a result of determination performed by said determination unit, one of the first determination method and a second determination method, for recovery printing after interruption of the print job, wherein the first determination method is a method of positioning the belt member in the all-contact position when an image of a page on which image formation is to be performed is a color image, and positioning the belt member in the partial-contact position when an image of a page on which image formation is to be performed is a monochrome image, and wherein the second determination method is a method of positioning the belt member in the all-contact position for all pages on which image formation is to be performed.

2. The image forming apparatus according to claim 1, wherein in recovery printing, in a case where it is determined as a result of determination by said determination unit that at least one color image is included in respective images for the pages on which image formation is to be performed in recovery printing, said selection unit selects the second determination method, whereas in cases other than the above-mentioned case, said selection unit selects the first determination method.

3. The image forming apparatus according to claim 1, further comprising a second obtaining unit configured to obtain information on the number of pages on which image formation is to be performed in recovery printing, and wherein in recovery printing, in a case where it is determined as a result of determination by said determination unit that a color image is included in the respective images for the pages on which image formation is to be performed in recovery printing, and also the number of pages obtained by said second obtaining unit is not larger than a predetermined number of pages, said selection unit selects the second determination method, whereas in cases other than the above-mentioned case, said selection unit selects the first determination method.

4. The image forming apparatus according to claim 1, further comprising:

a second obtaining unit configured to obtain information on the number of pages on which image formation is to be performed in recovery printing, and a calculation unit configured to calculate a color ratio which is a ratio of the number of pages of color images for recovery printing to the number of pages on which image formation is to be performed in recovery printing, and wherein in recovery printing, in a case where it is determined as a result of determination by said determination unit that a color image is included in respective images for the pages on which image formation is to be performed in recovery printing, and also the number of pages obtained by said second obtaining unit is not larger than a predetermined number, said selection unit selects the second determination method; in a case where it is determined as a result of determination by said determination unit that a color image is included in the respective images for the pages on which image formation is to be performed in recovery printing, also the number of pages obtained by said second obtaining unit is larger than the predetermined number, and also the color ratio calculated by said calculation unit is not lower than a predetermined ratio, said selection unit selects the second determination method; and in cases other than the above-mentioned cases, said selection unit selects the first determination method.

5. The image forming apparatus according to claim 1, wherein the plurality of image bearing members include a plurality of color image bearing members on which color toner images are formed, respectively, and a monochrome image bearing member on which a monochrome toner image is formed, and the part of the plurality of image bearing members is the monochrome image bearing member.

6. The image forming apparatus according to claim 5, wherein said shift unit shifts the belt member by displacing transfer members associated with the plurality of color image bearing members, respectively.

7. The image forming apparatus according to claim 1, wherein the cause of interruption is at least one of a jam of a recording sheet, a toner-out condition, and a paper-out condition.

8. An image forming apparatus that performs a sequence of image formation processing operations according to a print job, for forming a toner image on at least one of a plurality of image bearing members, transferring the toner image formed on at least one of the plurality of image bearing members onto a belt member, and further transferring the toner image, which has been transferred onto the belt member, onto a recording sheet, comprising:

a shift unit configured to shift the belt member to thereby switch a position of the belt member relative to the plurality of image bearing members to an all-contact position in which the belt member is in contact with all of the plurality of image bearing members or a partial-contact position in which the belt member is in contact with only part of the plurality of image bearing members;

a first obtaining unit configured to obtain color information indicative of whether an image to be formed is a color image or a monochrome image, concerning each page on which image formation is to be performed according to the print job;

a recovery unit configured to perform recovery printing in a case where the print job is interrupted due to a cause of interruption;

a selection unit configured to select, as a method of determining in which of the all-contact position and the partial-contact position, said shift unit is to position the belt member, a first determination method before a print job is interrupted, and select one of the first determination method and a second determination method, for recovery printing after interruption of the print job;

a second obtaining unit configured to obtain information on the number of pages on which image formation is to be performed in recovery printing; and an estimation unit configured to estimate a total switching time period which is a total of time periods each estimated to be required to perform switching of the belt member between the all-contact position and the partial-contact position, during image formation to be performed on all the pages according to the first determination method in recovery printing, estimate a total recovery image formation time period which is a time period estimated to be required to perform image formation on all the pages when image formation is performed on all the pages according to the first determination method in recovery printing, and further estimate a time ratio of the total switching time period to the total recovery image formation time period, wherein the first determination method is a method of positioning the belt member in the all-contact position when an image of a page on which image formation is to be performed is a color image, and positioning the belt member in the partial-contact position when an image of a page on which image formation is to be performed is a monochrome image, wherein the second determination method is a method of positioning the belt member in the all-contact position for all pages on which image formation is to be performed, and wherein in recovery printing, in a case where the number of pages obtained by said second obtaining unit is not larger than a predetermined number, said selection unit selects the second determination method; in a case where the number of pages obtained by said second obtaining unit is larger than the predetermined number, and also the time ratio estimated by said estimation unit is not lower than a predetermined ratio, said selection unit selects the second determination method; and in cases other than the above-mentioned cases, said selection unit selects the first determination method.

9. The image forming apparatus according to claim 8, wherein the plurality of image bearing members include a plurality of color image bearing members on which color toner images are formed, respectively, and a monochrome image bearing member on which a monochrome toner image is formed, and the part of the plurality of image bearing members is the monochrome image bearing member.

10. The image forming apparatus according to claim 9, wherein said shift unit shifts the belt member by displacing transfer members associated with the plurality of color image bearing members, respectively.

11. The image forming apparatus according to claim 8, wherein the cause of interruption is at least one of a jam of a recording sheet, a toner-out condition, and a paper-out condition.

* * * * *